US006326989B1

(12) United States Patent
Kohno et al.

(10) Patent No.: US 6,326,989 B1
(45) Date of Patent: Dec. 4, 2001

(54) PRINTER HEAD AND PRINTER

(75) Inventors: Minoru Kohno, Tokyo; Hideki Hirano, Kanagawa, both of (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/297,351

(22) PCT Filed: Aug. 27, 1998

(86) PCT No.: PCT/JP98/03824

§ 371 Date: Jul. 30, 1999

§ 102(e) Date: Jul. 30, 1999

(87) PCT Pub. No.: WO99/11464

PCT Pub. Date: Mar. 11, 1999

(30) Foreign Application Priority Data

Aug. 29, 1997 (JP) ..... 9-234522
Aug. 29, 1997 (JP) ..... 9-234523

(51) Int. Cl.[7] ..... B41J 2/335
(52) U.S. Cl. ..... 347/200; 347/56; 347/171
(58) Field of Search ..... 347/54, 56, 61, 347/200, 171

(56) References Cited

U.S. PATENT DOCUMENTS 5,828,391 * 10/1998 Shinozaki et al. ..... 347/51
6,120,130 * 9/2000 Hirano et al. ..... 347/46

FOREIGN PATENT DOCUMENTS 9-183246 7/1997 (JP) .

* cited by examiner

*Primary Examiner*—N. Le
*Assistant Examiner*—K. Feggins
(74) *Attorney, Agent, or Firm*—Sonnenschein, Nath & Rosenthal

(57) ABSTRACT

A thermal transfer printer head for discharging ink by heating ink to transfer ink to a transfer member. A sub-wall is provided in a supply passage adjacent to a transfer portion to raise the liquid level of ink in the supply passage so as to prevent a breakpoint of ink in the supply passage. Thus, ink consumed in the transfer portion is spontaneously replenished to the transfer portion through the supply passage by a capillary phenomenon so that continuous supply of ink to the transfer portion is smoothly performed. The structure is formed such that ink in an excessively large quantity is not introduced into a portion above a heater provided for the transfer portion. As a result, even if the wettability of an ink holding structure formed above the heater is raised owning to adhesion of thermally degraded substances or the like, introduction of ink into the portion above the heater in a large quantity and rapid change in the quantity of transferred ink can be prevented.

28 Claims, 16 Drawing Sheets

PRINTER HEAD AND PRINTER

FIELD OF THE INVENTION

The present invention relates to a so-called thermal transfer printer head for transferring ink to a transfer member, such as printing paper, by heating and discharging ink and to a printer.

DESCRIPTION OF THE RELATED ART

In recent years, a color image processed by a personal computer or the like or a color image photographed by an electronic still camera or the like has been printed out for the purpose of appreciating the image. Therefore, there arises a need for a printer with which a full color image exhibiting a high quality can be obtained. In particular, there arises a need for a relatively low-cost and personal use printer oriented to a small-size office, for example, a "small office" or a "home office".

Color printing methods have been suggested which include a dye-sublimation thermal transfer method (or a dye diffusion thermal transfer method), a melt thermal transfer method, an ink jet method, an electronic photography method, a thermal development silver-salt method and so forth. Among the foregoing methods, the dye diffusion thermal transfer method and the ink jet method are methods with which a high-quality image can easily be output with a relatively simple structure.

The dye diffusion thermal transfer method has a step of applying an ink layer, in which a high-concentration transfer dye is dispersed in appropriate binder resin, to an ink ribbon or a sheet. Then, the ink ribbon or the sheet is brought into intimate contact with so-called thermal transfer paper coated with dye resin for accepting transferred dye. Then, heat is applied to the surface of the ink ribbon or the sheet from a heat sensitive head (a thermal head). Thus, the transfer dye is thermally transferred from the ink ribbon or the sheet to the thermal transfer paper in accordance with the quantity of heat.

The above-mentioned process is repeated for an image signal decomposed into yellow (Y), magenta (M) and cyan (C) which are three primary colors of subtractive color mixture. Thus, a full color image having a continuous gradient can be obtained.

FIG. 25 is a diagram showing the structure of a portion including a thermal head of a printer adapted to the above-mentioned method.

A thermal head 101 is disposed opposite to a platen roller 102. An ink sheet 103 having a base film 103*b*, on which an ink layer 103*a* is formed, and thermal transfer paper 104 incorporating paper 104*b* coated with a dye resin layer (a dye acceptance layer) 104*a* are moved between the thermal head 101 and the platen roller 102. During the movement, the ink sheet 103 and the thermal transfer paper 104 are pressed against the thermal head 101 by the rotating platen roller 102.

In accordance with an image which must be printed, ink contained in the ink layer 103*a* selectively heated by the thermal head 101 is, by heat, dispersed in the dye resin layer 104*a* in the thermal transfer paper 104 brought into contact with the ink layer 103*a* and thus heated. Thus, transfer in the form of a dot pattern is performed.

The dye diffusion thermal transfer method is an excellent technique because the size reduction and maintenance of the printer can easily be performed, immediacy is realized and an image equivalent to a silver salt color photograph can be obtained. The foregoing method, however, suffers from a problem of a large quantity of a waste caused from the disposable ink ribbon or the sheet and an excessively high running cost. Moreover, the thermal transfer paper must be used, causing another problem to arise in that the cost cannot be reduced.

Although the melt thermal transfer method is able to transfer an image to plain paper, use of the ink ribbon or the sheet raises similar problems of the large quantity of waste caused from the disposable ink ribbon and the sheet and the high running cost. A problem exits in that the quality of the printed image is inferior to that obtainable from the silver salt photograph.

Although the thermal development silver salt method is able to form a high quality image, similar problems arise in that the running cost cannot be reduced because dedicated photographic paper and disposable ribbon or sheet are used. Another problem is that the above-mentioned method utilizes a costly apparatus.

As disclosed in, for example Japanese Patent Publication No. 61-59911 and Japanese Patent Publication No. 5-217, the ink jet method is adapted to any one of an electrostatic attraction method, a continuous oscillation generation method (a piezoelectric method) and a thermal method (a bubble jet method). A small droplet of ink is jetted out from a nozzle provided for a printer head to allow the droplet to adhere to printer paper or the like so as to print an image.

Therefore, transfer to plain paper is permitted. In addition, the running cost can be reduced because the ink ribbon is not used. Moreover, waste caused from use of the ink ribbon or the like can substantially be prevented. Recently, the thermal method has widely been used because a color image can easily be printed.

However, the ink jet method encounters a difficulty in realizing a gradient in the density in a pixel because of the principle of the method. Therefore, an image having a high quality equivalent to that of the silver salt photograph obtainable from the dye diffusion thermal transfer method cannot be reproduced in a short time. That is, the conventional ink jet method, with which one droplet of ink forms one pixel, cannot easily realize a gradient in a pixel because of the principle of the method. Therefore, a high-quality image cannot be formed. Although an attempt using the high resolution has been made to realize pseudo gradient by a dither method, a quality of an image equivalent to that obtainable from the dye diffusion thermal transfer method cannot be obtained. What is worse, the transfer rate is excessively reduced.

Recently, an ink jet method has appeared which uses diluted ink to obtain two- or three-step gradient. However, quality of an image equivalent to that obtainable from the silver salt photograph or the dye diffusion thermal transfer method cannot be realized in a case of an image, such as a natural image.

On the other hand, the electrophotographic method, which is able to reduce the running cost and realize a high transfer rate, cannot print an image having a quality equivalent to that obtainable from the silver salt photograph. Moreover, an excessively high cost is required for the apparatus.

That is, any one of the foregoing methods cannot simultaneously satisfy the requirements for realizing a high image quality, a low running cost, a low apparatus cost and a short transfer time.

As a color printing method which is able to satisfy all of the above-mentioned requirements, a so-called dye-vaporization thermal transfer method has been suggested (refer to, for example, Japanese Patent Laid-Open No. 7-89107 and Japanese Patent Laid-Open No. 7-89108).

The foregoing method has the step of heating ink in a transfer portion of a printer head to discharge ink by vaporization or ablation. Thus, ink is allowed to adhere to the surface of a transfer member, such as printing paper, disposed at an opposite position through a gap of about 50 μm to about 100 μm so that ink is transferred.

The transfer portion incorporates an ink holding structure having an irregular portion which incorporates a multiplicity of columnar members. Each of the columnar members has a width of, for example, about 2 μm and a height of, for example, about 6 μm. The columnar members are stood erect and positioned apart from one another at small intervals of about 2 μm. A heater is disposed below the ink holding structure. Thus, a vaporizing portion is constituted.

Since the above-mentioned ink holding structure is provided for the transfer portion, the following effects (1) to (4) can be obtained:

(1) The capillary phenomenon allows ink to spontaneously be supplied to the vaporizing portion.

(2) A large surface area enables ink to efficiently be heated.

(3) When the height of each of the columnar members is determined arbitrarily, ink in a predetermined quantity can always be held in the vaporizing portion.

(4) Since the surface tension of liquid generally has a negative temperature coefficient, force oriented toward the outer portion, the temperature of which is low, is exerted on ink. Since the ink holding structure minimizes the ink movement, deterioration in the transfer sensitivity can be prevented.

Therefore, provision of the foregoing ink holding structure enables ink to be discharged in a quantity corresponding to the degree of heating performed in the vaporizing portion. Thus, ink is allowed to adhere to the printing paper or the like. Therefore, the quantity of ink which must be transferred can be controlled, that is, a density gradient can be realized in a pixel. As a result, an image can be obtained which has a quality equivalent to that obtainable from silver-salt color photograph.

Since use of the ink ribbon is not required, the running cost can be reduced. When ink having a high absorptivity with respect to plain paper is used, transfer to plain paper can be performed. Therefore, cost can be reduced because the plain paper is used.

Since the foregoing method uses vaporization or ablation of ink, the necessity of, at a high pressure, pressing the transferring portion of the printer head which heats ink against the transfer member, such as printing paper, can be eliminated. Moreover, the necessity of bringing the transferring portion into contact with the transfer member can be eliminated. Therefore, a problem frequently experienced with the other thermal transfer method can be prevented which arises in that thermal fusion occurs between the ink heating portion, such as the ink ribbon, and the printing paper.

Similarly to the foregoing dye diffusion thermal transfer method, the foregoing dye-vaporization thermal transfer method enables reduction in the size and easy maintenance of the printer and immediacy to be realized and an image having an excellent quality to be formed. Moreover, waste and running cost can be reduced because the ink ribbon or the like is not used. In addition, cost reduction can be realized because plain paper can be used. Therefore, the foregoing method is an excellent technique.

However, the conventional printer adapted to the above-mentioned method has a problem to be overcome.

That is, the printer adapted to the foregoing method has the printer head incorporating a transfer portion structured such that ink in a quantity consumed in the vaporizing portion is spontaneously replenished to the vaporizing portion owning to the capillary phenomenon in the ink holding portion. The ink supply passage formed adjacent to the transfer portion must store ink in a sufficiently large quantity to supply ink to the transfer portion. If the quantity of ink is insufficient in the ink supply passage, ink cannot be supplied in time from the ink supply passage to the transfer portion. As a result, the quantity of ink which must be supplied is made to be insufficient with respect to the quantity of ink vaporization. Thus, the transfer density is lowered and continuous supply of ink cannot be maintained. As a result, a white line sometimes forms in a transferred image owning to shortage of ink.

As described above, the printer adapted to the foregoing method is structured such that ink held in the vaporizing portion in the transfer portion of the printer head is vaporized or ablated so as to be transferred. When the transfer is being stably performed, substantially no ink is present in the central portion of the vaporizing portion. Therefore, vaporization of ink substantially takes place in the vicinity of the boundary of the vaporizing portion. If adhesion of substances degraded with heat or the like causes the surface characteristic of the columnar members of the ink holding structure to be changed, ink is introduced into the central portion of the vaporizing portion. In this case, a phenomenon that the transfer sensitivity is rapidly raised frequently occurs. As a result, the irregularity in the density of the printed image becomes too critical as time elapses to maintain the quality of the printed image.

SUMMARY OF THE INVENTION

An object of the present invention is to provide a printer head and a printer having a structure to satisfactorily use the characteristics of the above-mentioned dye-vaporization thermal transfer method by enabling ink in a sufficiently large quantity to always be held in an ink supply passage which supplies ink to a transfer portion. Another object is to provide a printer head and a printer structured to prevent change in the quantity of discharged ink owning to heat generated by a heater after time has elapsed to prevent deterioration in the quality of an image as time elapses.

In an embodiment of the present invention a printer head includes an ink transferring portion for transferring ink to a transfer member positioned opposite to the ink transferring portion; and an ink supply passage for supplying ink to the ink transferring portion. The ink transferring portion incorporates a heater for heating ink to discharge ink and an ink holding structure disposed above at least the heater and having a plurality of small gaps so as to introduce ink into the small gaps by using a capillary phenomenon and hold the ink, and the ink supply passage incorporates ink-level holding means for maintaining a predetermined height of the ink level by using surface tension of ink.

In an embodiment of the present invention a printer includes a printer head incorporating an ink transferring portion for transferring ink to a transfer member positioned opposite to the ink transferring portion and an ink supply passage for supplying ink to the ink transferring portion, wherein the ink transferring portion incorporates a heater for heating ink to discharge ink and an ink holding structure disposed above at least the heater and having a plurality of small gaps so as to introduce ink into the small gaps by using a capillary phenomenon and hold ink, and the ink supply passage incorporates ink-level holding means for maintaining a predetermined height of the ink level by using a surface tension of the ink.

In another embodiment of the present invention a printer head includes a heater for heating ink to discharge ink; and an ink holding structure disposed above at least the heater and having a plurality of small gaps so as to introduce ink into the small gaps by using a capillary phenomenon and hold ink, wherein the ink holding structure is present at least a portion above the peripheral portion of the heater, and a portion above the central portion of the heater is formed into a gap which is larger than each of the small gaps.

In another embodiment of the present invention a printer head includes a heater for heating ink to discharge ink; and an ink holding structure disposed in a predetermined region including a portion above the heater and having a plurality of small gaps so as to introduce ink into the small gaps by using a capillary phenomenon and hold ink, wherein a portion of the ink holding structure above the heater has gaps wider than the small gaps disposed in the portions except for the portion above the heater.

In an embodiment of the present invention a printer head includes a heater for heating ink to discharge ink; and an ink holding structure disposed above at least the heater and having a plurality of small gaps so as to introduce ink into the small gaps by using a capillary phenomenon and hold ink, wherein the ink holding structure has an ink-introduction preventive wall formed in a portion above the inside portion of the periphery of the heater so as to prevent introduction of ink into a portion above the central portion of the heater.

In an embodiment of the invention a printer includes a printer head incorporating a heater for heating ink to discharge ink and an ink holding structure disposed above at least the heater and having a plurality of small gaps so as to introduce ink into the small gaps by using a capillary phenomenon and hold ink, wherein the ink holding structure is present in at least a portion above the peripheral portion of the heater, and a portion above the central portion of the heater is formed into a gap which is larger than each of the small gaps.

In an embodiment of the present invention a printer includes printer head incorporating a heater for heating ink to discharge ink and an ink holding structure disposed in a predetermined region including a portion above the heater and having a plurality of small gaps so as to introduce ink into the small gaps by using a capillary phenomenon and hold ink, wherein a portion of the ink holding structure above the heater has gaps wider than the small gaps disposed in the portions except for the portion above the heater.

In an embodiment of the invention a printer includes a printer head incorporating a heater for heating ink to discharge ink and an ink holding structure disposed above at least the heater and having a plurality of small gaps so as to introduce ink into the small gaps by using a capillary phenomenon and hold ink, wherein the ink holding structure has an ink-introduction preventive wall formed in a portion above the inside portion of the periphery of the heater so as to prevent introduction of ink into a portion above the central portion of the heater.

DETAILED DESCRIPTION OF THE DRAWINGS

DETAILED DESCRIPTION OF THE PRESENTLY PREFERRED EMBODIMENTS

First Embodiment

Figure 8:
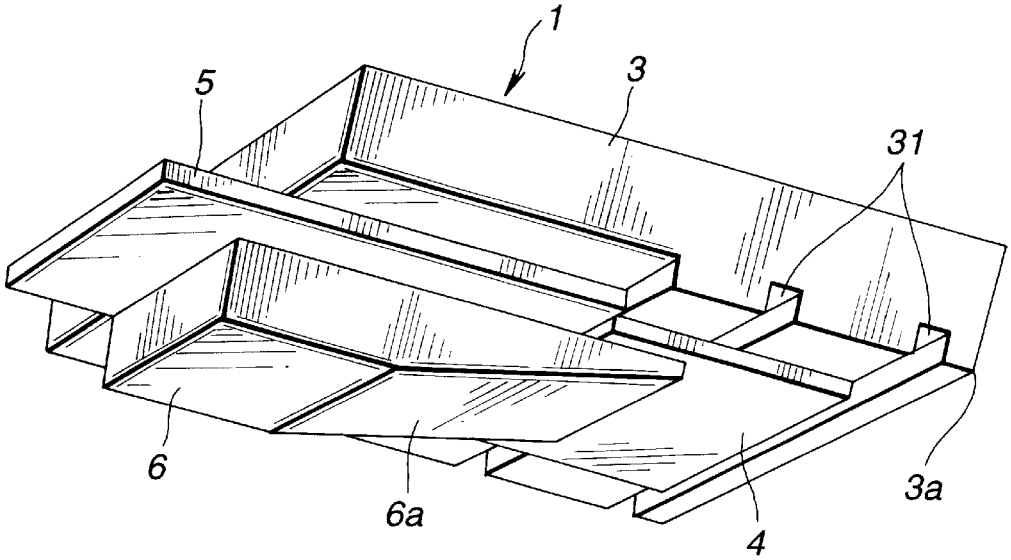
FIG. 8 is a schematic perspective view showing the shape of the printer head according to the first embodiment of the present invention.
Figure 9:
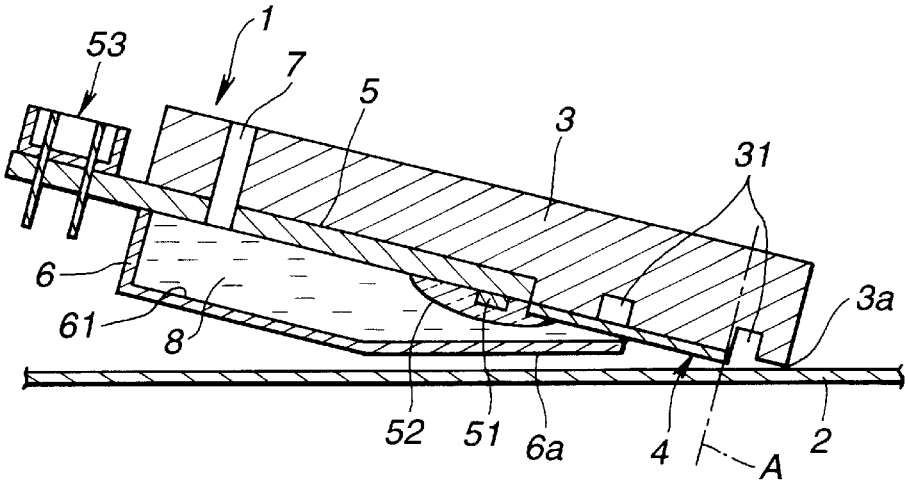
FIG. 9 is a schematic cross sectional view showing a printing method adapted to the printer head according to the first embodiment of the present invention.
Figure 10:
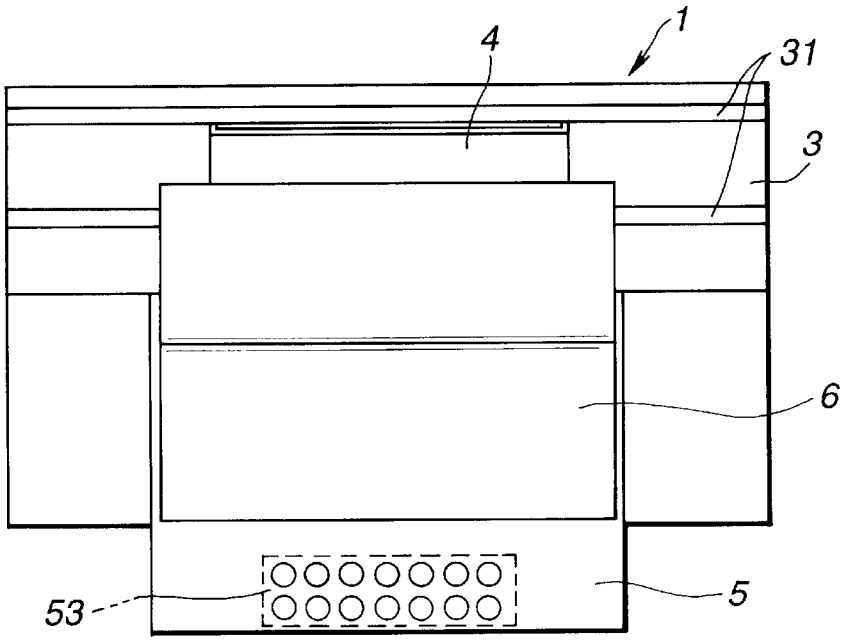
FIG. 10 is a schematic bottom view showing the printer head according to the first embodiment of the present invention.
Figure 11:
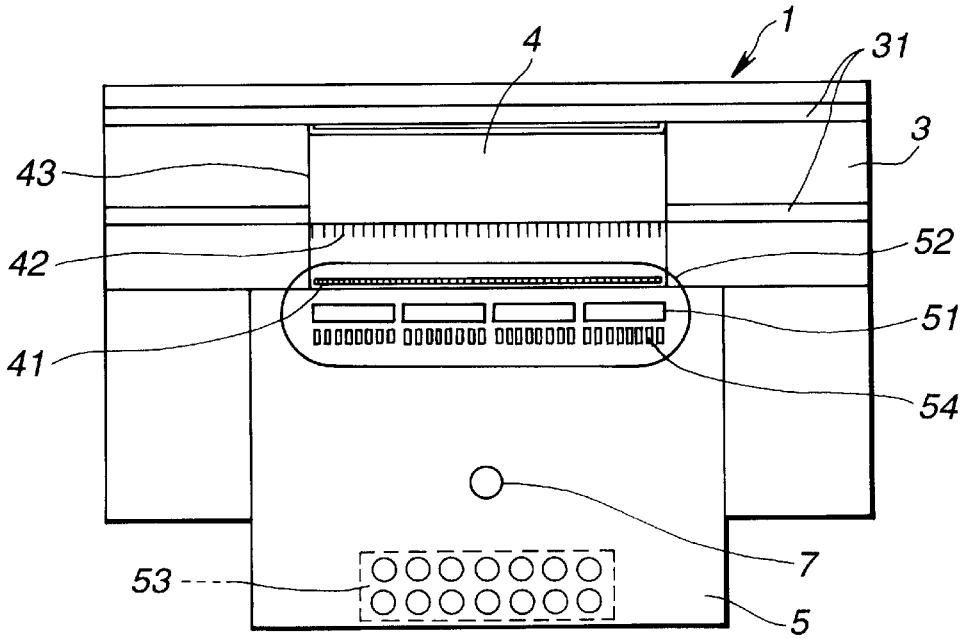
FIG. 11 is a schematic bottom view showing a state of the printer head according to the first embodiment of the present invention in which a cover has been removed.

FIG. 8 is a schematic perspective view showing the shape of a printer head according to a first embodiment of the present invention. FIG. 9 is a schematic cross sectional view showing a state of a transferring operation which is performed by the printer head to transfer ink to paper, such as printing paper. FIG. 10 is a bottom view of the printer head. FIG. 11 is a bottom view showing a state in which a cover of an ink accumulating portion of the printer head has been removed.

As shown in the drawings, a printer head 1 incorporates a head base 3 which also serves as a heat sink made of, for example, aluminum (Al). Transfer portions to be described later are formed in a portion adjacent to the leading end of the lower surface of the head base 3 by bonding a heater chip 4 formed on a silicon substrate with a silicon bond. The position indicated with an alternate long and short dash line A shown in FIG. 9 is the center of discharge of ink in each of the transfer portions. In the bonded portion of the heater chip 4, grooves 31 are formed in the surface of the head base 3 in order to uniformly bond the heater chip 4. An excessive portion of the bond for bonding the heater chip 4 can be relieved into the grooves 31.

A printed circuit board 5 having driver ICs 51 (see FIGS. 9 and 11) for use in heating operations and the like mounted thereon is bonded to the head base 3 with, for example, the silicon bond. As shown in FIG. 9, a portion of the head base 3 to which the printed circuit board 5 is joined is formed into a recess, the height of which is reduced to correspond to the thickness of the printed circuit board 5. When the printed circuit board 5 has been joined to the recess, the height including the driver ICs 51 mounted on the printed circuit board 5 is substantially the same as the height of the upper surface of the heater chip 4 joined in parallel with the printed circuit board 5.

A portion in which the electrode pattern 41 (see FIG. 11) on the heater chip 4 and the driver ICs 51 are connected to one another and a portion in which the driver ICs 51 and the circuit pattern 54 (see FIG. 11) on the printed circuit board 5 are connected to one another are coated with silicon coating JCR (Junction Coating Resin) 52 to protect bonding wires (not shown) for establishing the connections. The JCR 52 is hardened with heat.

As shown in FIGS. 8 to 10, a cover 6 is bonded to a region which covers a portion of the printed circuit board 5 and that of the heater chip 4 with, for example, a silicon bond similarly. As shown in FIGS. 9 and 11, an ink introducing opening 7 which penetrates the head base 3 and the printed circuit board 5 is formed. Ink 8 supplied from an ink tank (not shown) through a flexible pipe (not shown) and so forth is passed through the ink introducing opening 7 so as to be supplied to an ink accumulating portion 61 formed in the cover 6. Then, as shown in FIG. 11, ink 8 is supplied from the ink accumulating portion 61 to each transfer portion (not shown) formed at the leading end portion of the heater chip 4 through a multiplicity of ink supply passages constituted by a multiplicity of partition walls 42 and a cover 43.

When a printing operation is performed, the printer head 1 is, as shown in FIG. 9, held to be inclined with respect to a paper sheet 2 at a predetermined angle in a state in which a leading end 3*a* of the head base 3 adjacent to heater chip 4 makes contact with the paper sheet 2. Therefore, intervals between the transfer portions (not shown) and the paper sheet 2 at ink discharge center A are always maintained to be a constant gap of, for example, 50 $\mu$m to 500 $\mu$m.

As shown in FIGS. 8 and 9, the cover 6 to be joined to the printer head 1 has an inclined surface 6*a* formed previously and corresponding to the angle of inclination between the printer head 1 and the paper sheet 2. Thus, the cover 6 does not obstruct the printing operation.

Reference numeral 53 shown in FIGS. 9 to 11 represents a connector for connecting the electric wires in the printed circuit board 5 to, for example, an FPC (Flexible Print Circuit) (not shown).

Figure 1:
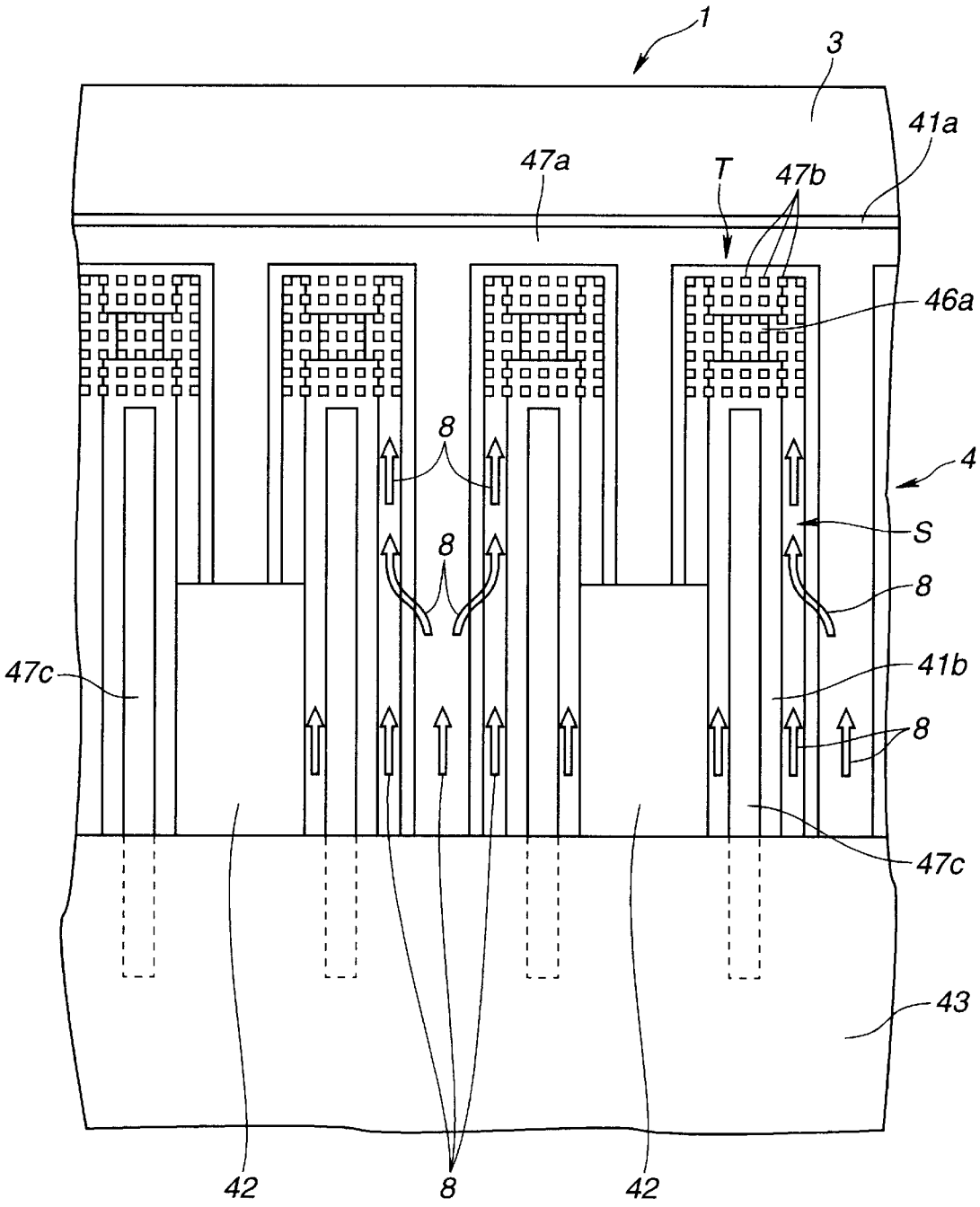
FIG. 1 is a schematic plan view showing a portion including transfer portions of a printer head according to a first embodiment of the present invention.
Figure 5:
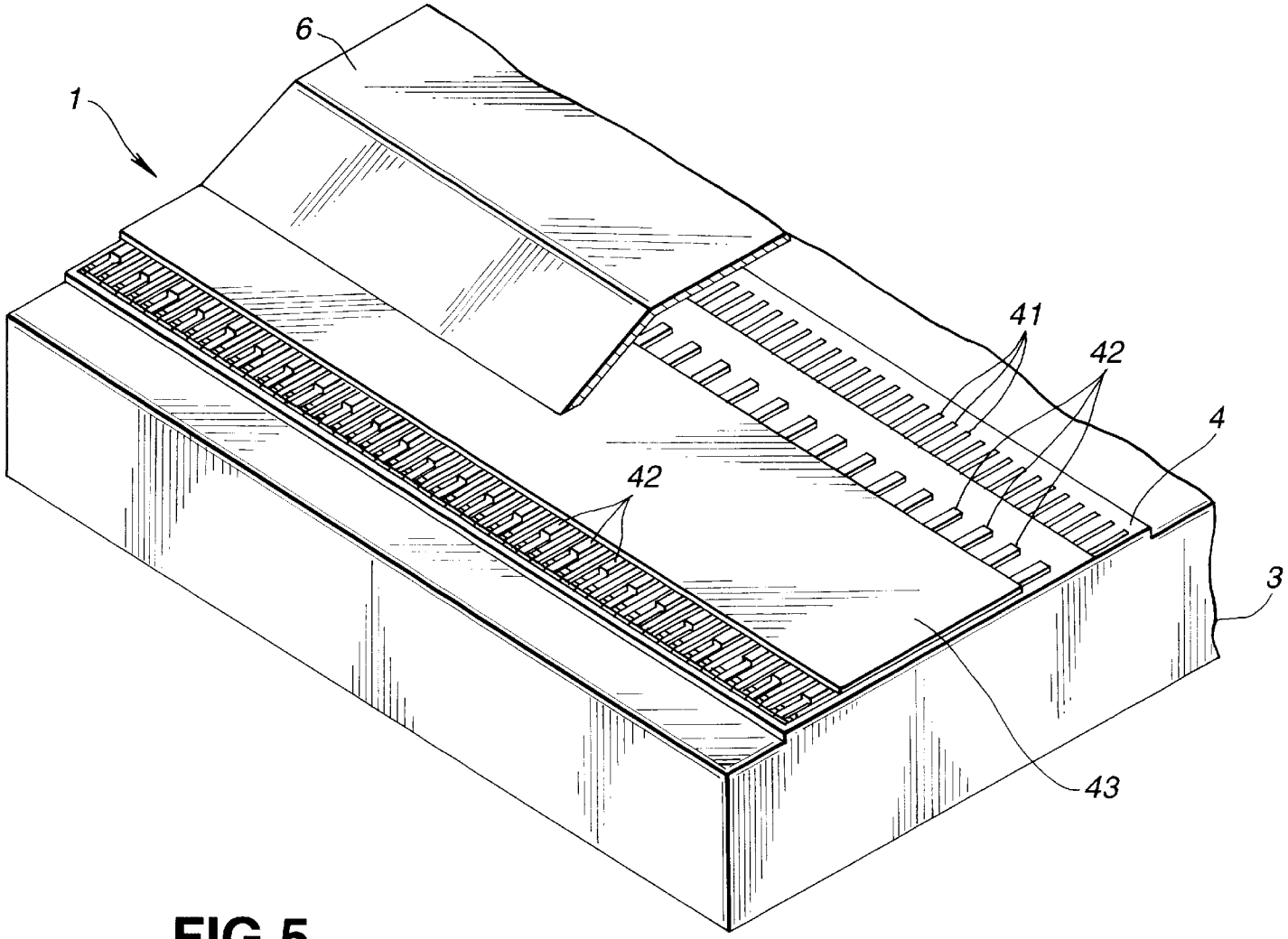
FIG. 5 is a partially-broken perspective view showing the shape of a leading end of the printer head according to the first embodiment of the present invention.
Figure 6:
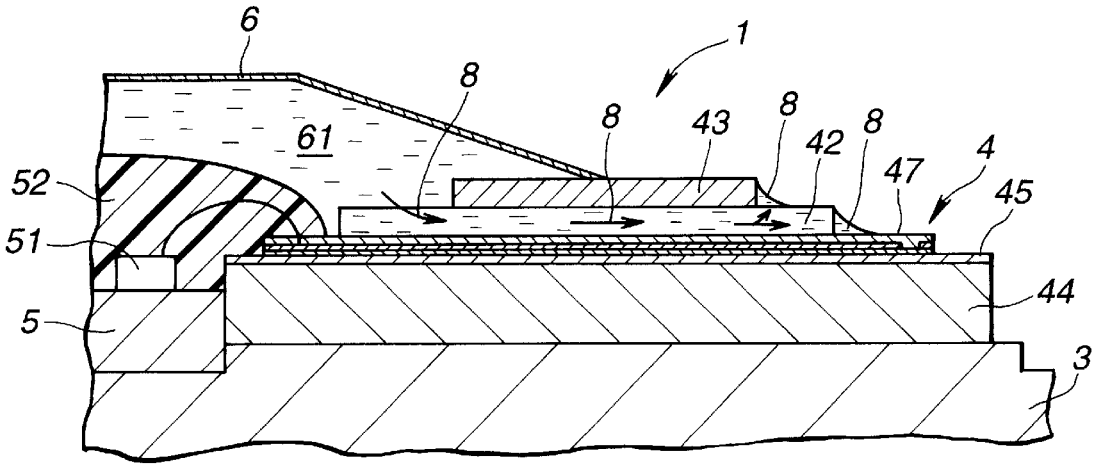
FIG. 6 is a schematic cross sectional view showing the structure of a leading end of the printer head according to the first embodiment of the present invention.
Figure 7:
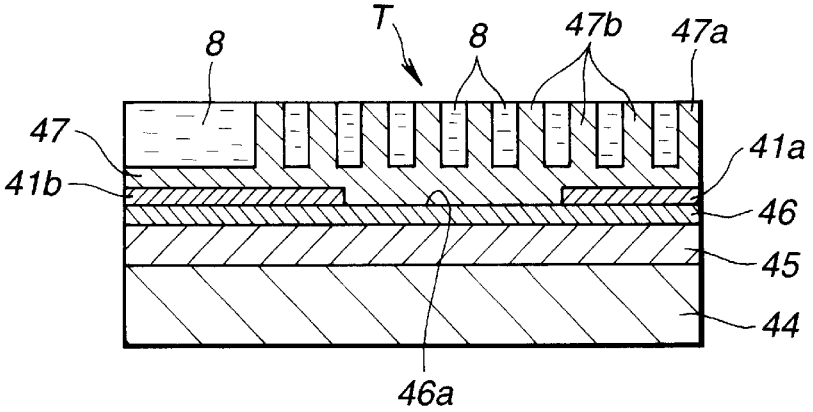
FIG. 7 is an enlarged schematic cross sectional view showing the structure of a transfer portion of the printer head according to the first embodiment of the present invention.

FIG. 1 is a plan view showing a portion including the transfer portions formed in the leading end portion of the heater chip 4. FIG. 5 is a perspective view showing the heater chip 4 joined to the head base 3 in a state in which the cover 6 is illustrated in a partially broken state. FIG. 6 is a schematic cross sectional view mainly showing the heater chip 4. FIG. 7 is an enlarged schematic cross sectional view showing the transfer portions of the heater chip 4.

As shown in FIGS. 6 and 7, the heater chip 4 incorporates a substrate 44 made of, for example, silicon. A high-resistance polysilicon film 46, which is formed into a heater, is formed on the substrate 44 through a silicon oxide ($SiO_2$) film 45. When, for example, an insulating substrate, for example, a quartz substrate, is employed as the substrate 44, the insulating film, such as the $SiO_2$ film 45, may be omitted. In this case, the polysilicon film 46 is directly formed on the substrate 44.

Figure 4:
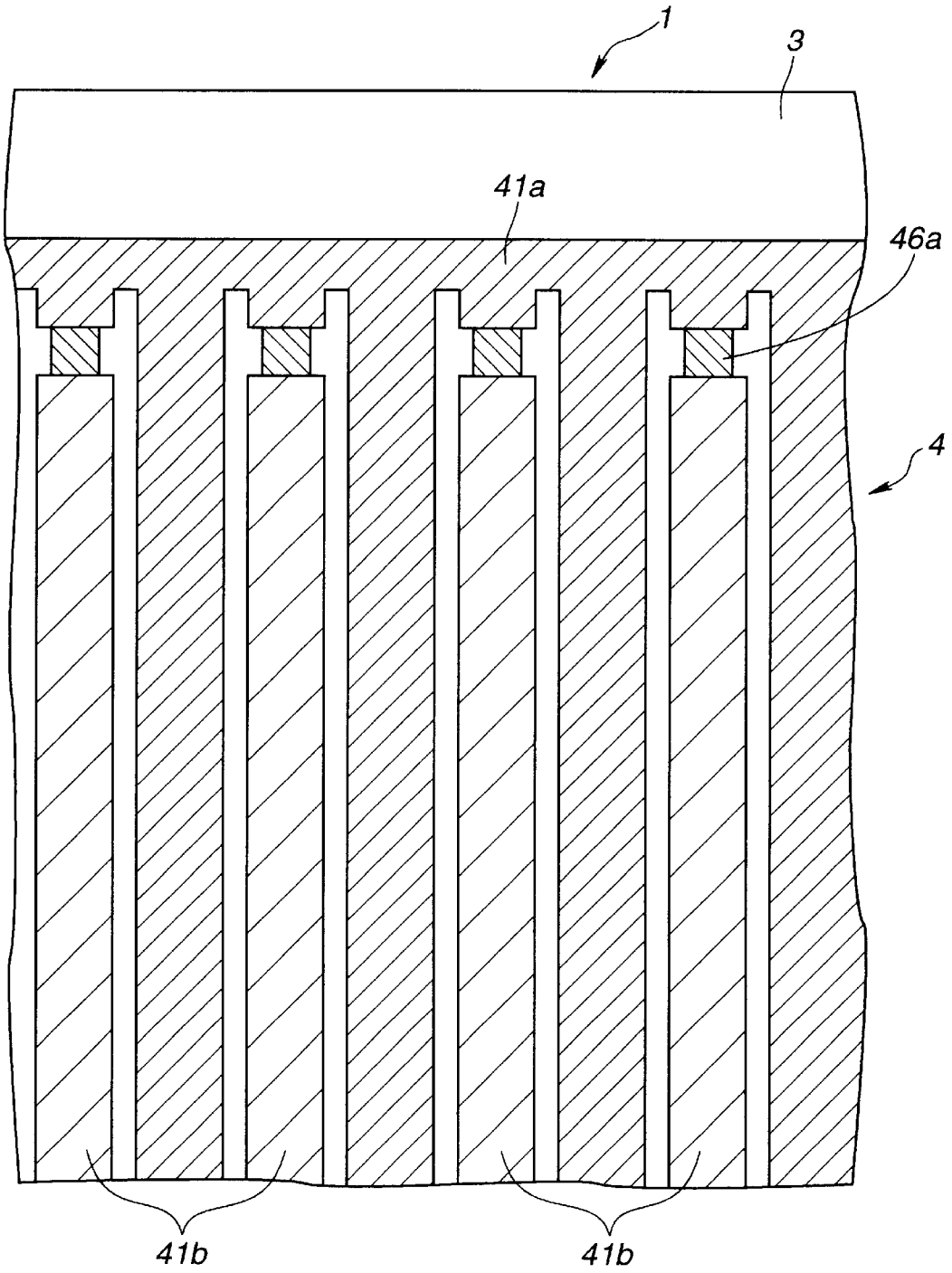
FIG. 4 is a schematic plan view showing an electrode pattern of the printer head according to the first embodiment of the present invention.

As shown in FIG. 7, a common electrode 41*a* and individual electrodes 41*b* in the form of an aluminum (Al) circuit pattern are formed on the polysilicon film 46. FIG. 4 is a plan view showing the pattern of the common electrode 41*a* and the individual electrodes 41*b* corresponding to FIG. 1. Referring to FIG. 4, the polysilicon film 46 is also formed below each of the electrodes 41*a* and 41*b* (see FIG. 7). That is, the polysilicon film 46 serves as a portion of the electric circuit in portions each having an electrode thereon. Portions 46*a* having no electrode thereon serve as heaters using resistance heating. The heater portions 46*a*, selected by the common electrode 41*a* and the individual electrodes 41*b* in accordance with image information which must be printed, are heated. Thus, ink existing on the common electrode 41*a* is vaporized or ablated so that ink is transferred to a transfer member, such as the paper sheet 2 (see FIG. 9).

For example, 256 heater portions 46*a* each having a size of about 20 $\mu$m×20 $\mu$m are formed on one heater chip 4 at intervals of about 84.7 $\mu$m. Since one heater corresponds to transfer of one dot, a resolution of 300 dpi is realized.

As shown in FIGS. 6 and 7, a $SiO_2$ film 47 serving as a protective film is formed on the overall surface of the heater chip 4 including the electrodes 41*a* and 41*b*. As shown in FIGS. 1 and 7, partition walls 47*a* surrounding each of the transfer portions T and forming supply passages S for supplying ink to the transfer portions T and columnar members 47*b* for forming each ink holding structure in each of the transfer portions T are formed as portions of the $SiO_2$ film 47. That is, the $SiO_2$ film 47 formed to have a predetermined thickness by, for example, a CVD (Chemical-Vapor Deposition) method, is anisotropic-etched by, for example, a RIE (Reactive Ion Etching) method. Thus, the partition walls 47*a*, the columnar members 47*b* and the other portions of the protective film are simultaneously formed.

As shown in FIG. 1, each of the transfer portions T has columnar members 47*b* in a 9×9 square matrix (note that FIG. 1 shows 7×7 matrix). Among the columnar members 47*b*, 3×3 columnar members 47*b* are positioned above the heater portion 46*a*. For example, each of the columnar members 47*b* has a width of about 0.2 $\mu$m to about 10 $\mu$m and a height of about 2 $\mu$m to about 15 $\mu$m. The columnar members 47*b* are disposed at intervals of, for example, about 0.2 $\mu$m to about 10 $\mu$m. Note that the shape of each of the columnar members 47*b* is not limited to the illustrated square shape. For example, the columnar member 47*b* may be formed into a cylindrical shape.

As shown in FIG. 1, the supply passages S for supplying ink to the transfer portions T are defined by the partition walls 47*a* having the same height as those of the columnar members 47*b* in the transfer portions T. As shown in FIGS. 1 and 6, each of ink passages for supplying ink from the ink accumulating portion 61 to the supply passages S is formed into a tunnel shape by partition walls 42 in the form of a sheet resist pattern and a cover 43 constituted by, for example, a nickel (Ni) sheet (see FIG. 5).

As shown in FIGS. 1 and 6, in the transfer portions T, partition walls 42 made of sheet resists are formed from the central portion of the heater portion 46*a* of the transfer portion T to a rearward position apart from the central portion for a distance of about 100 $\mu$m. The cover 43 is formed from the ends of the partition walls 42 to a rearward position apart from the ends for a distance of about 100 $\mu$m. As a result of the above-mentioned structure, excessive supply of ink to the transfer portions T can be prevented. That is, as shown in FIG. 6, ink 8 which is supplied from the ink accumulating portion 61 flows as follows. Initially, the liquid level of ink 8 is raised along the wall surface of the cover 43 at a position adjacent to an outlet port of the cover 43 by the wettability and the surface tension of ink 8. Then, the liquid level is gradually lowered. A similar phenomenon occurs adjacent to the ends of the partition walls 42. Therefore, ink 8 flows in a state in which the liquid level is gradually lowered from the wall surfaces of the ends of the partition walls 42. Therefore, if the partition walls 42 and the cover 43 are formed in excessively close to the transfer portions T, there is apprehension that excess ink is supplied to the transfer portions T. If excess ink is supplied to the transfer portions T, in particular, the portions above the heater portions 46*a*, energy required to vaporize or ablate ink is enlarged excessively. Thus, the transfer efficiency deteriorates. The structure in which the partition walls 42 and the cover 43 are formed at rearward positions is also attempted to prevent contact of the partition walls 42 and the cover 43 with the transfer member, such as the paper sheet 2 (see FIG. 9) disposed opposite to the transfer portions T.

As shown in FIG. 1, ink 8 allowed to flow through the ink passage defined by the partition walls 42 made of the sheet resist is separated above the partition wall 47*a* for defining the supply passage S in front of each of the transfer portions T. Then, ink 8 is introduced into each of the supply passages S. In each of the transfer portions T, ink 8 is held at substantially the same height as the upper surfaces of the partition walls 47*a* and the columnar members 47*b*, as shown in FIG. 7. Since each of the transfer portions T has the ink holding structure constituted by the columnar members 47*b* as described above, ink 8 in a predetermined quantity can always be held in each of the transfer portions T.

Ink in each of the transfer portions T consumed owning to heating of the heater portions 46*a* is spontaneously replenished to the portions above the heater portions 46*a* by dint of a capillary phenomenon realized because of the existence of the columnar members 47*b*. The foregoing flow of ink 8 from the ink accumulating portion 61 to each of the transfer portions T is caused from the spontaneous flow of ink 8.

As shown in FIG. 1, the first embodiment has a structure which incorporates sub-walls 47*c* formed in the supply passage S in front of each of the transfer portions T, the sub-walls 47*c* being disposed at substantially the central position between a pair of partition walls 47*a* which define the supply passages S. The sub-walls 47*c* are simultaneously formed with the partition walls 47*a* and the columnar members 47*b* from the $SiO_2$ film 47. Therefore, the sub-walls 47*c* have the same heights as those of the partition walls 47*a* and the columnar members 47*b*.

The effect of the sub-walls 47*c* is described in greater detail below.

Figure 3A:
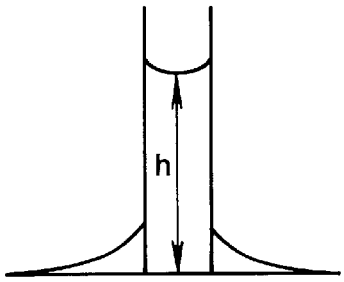
FIG. 3A is a schematic view showing change in the liquid level of ink.

Ink is held in each of the transfer portions T by dint of the capillary phenomenon which occurs between the opposite solid walls. For example, the liquid level of liquid present between two vertical partition walls as shown in FIG. 3A is raised to height h which is determined by an angle of contact between liquid and the partition walls, the surface tension of liquid and the distance between the partition walls if liquid wets the partition walls. In the first embodiment, the heights of the partition walls 47*a* and the columnar members 47*b* in each of the transfer portions T are lower than the above-mentioned height h. Therefore, the liquid level of ink 8 is maintained at about the heights of the partition walls 47*a* and the columnar members 47*b*, as shown in FIG. 7.

Figure 3B:
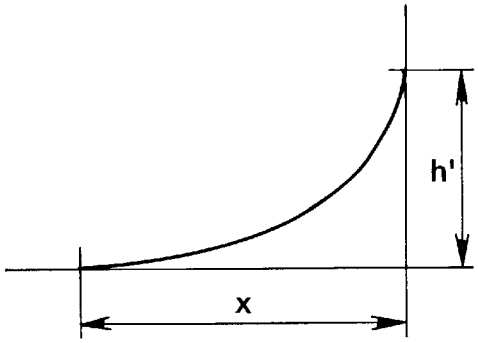
FIG. 3B is a schematic view showing change in the liquid level of ink.

If the distance between the partition walls is long as shown in FIG. 3B, the liquid level is gradually lowered from height h' which is determined by the angle of contact between the liquid and each of the vertical wall surface and the surface tension of liquid. Thus, liquid is brought into contact with the bottom surface at a position distant from the wall surface for distance x. If the above-mentioned state occurs at an intermediate position of the ink supply passage, a breakpoint of ink is undesirably formed. As a result, ink supply is interrupted.

Figure 2A:
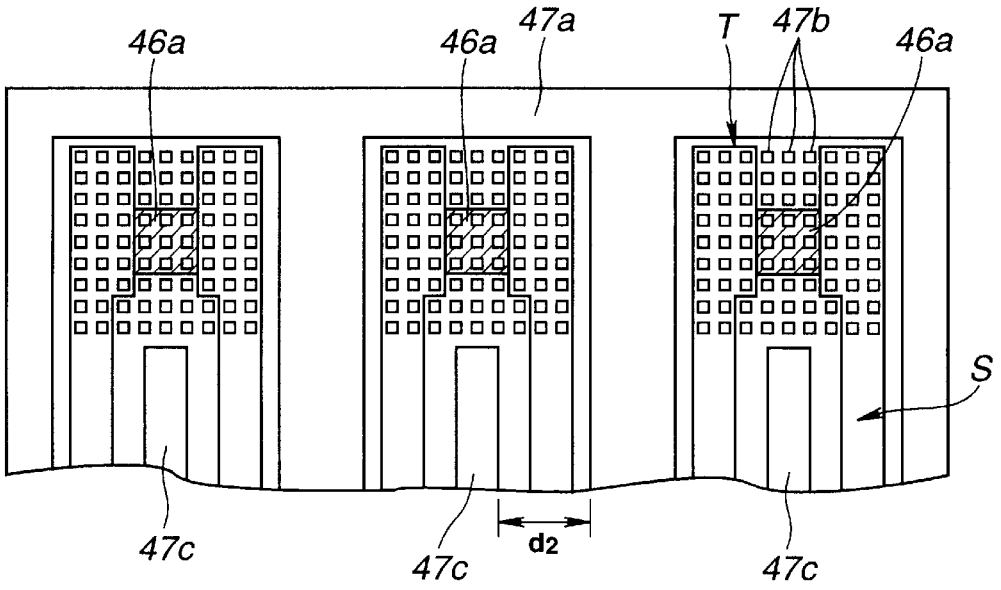
FIG. 2A is an are enlarged schematic plan view showing portions each including transfer portions of the printer head according to the first embodiment of the present invention and a conventional printer head.
Figure 2B:
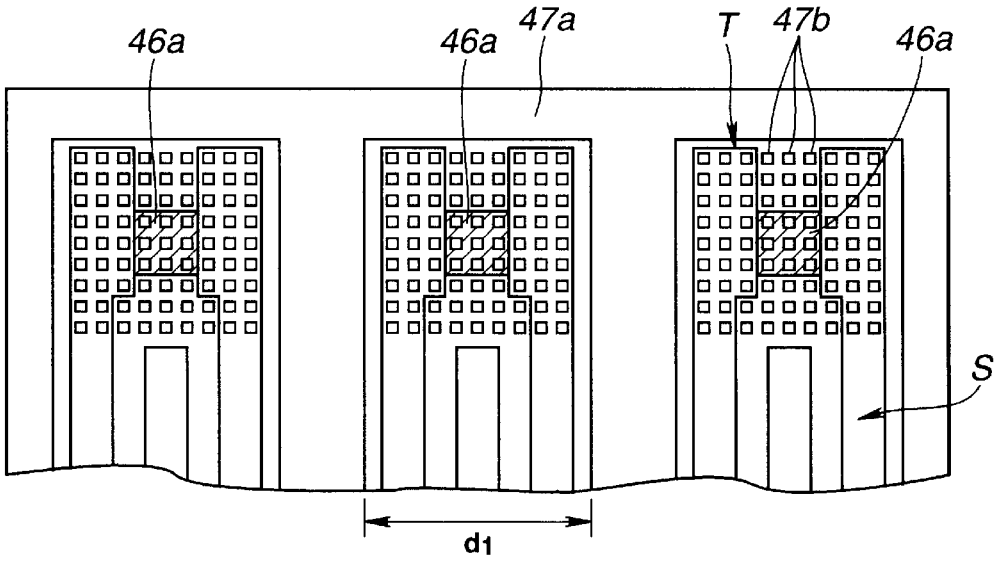
FIG. 2B is an enlarged schematic plan view showing portions including transfer portions of the printer head according to the first embodiment of the present invention and a conventional printer head.
Figure 3C:
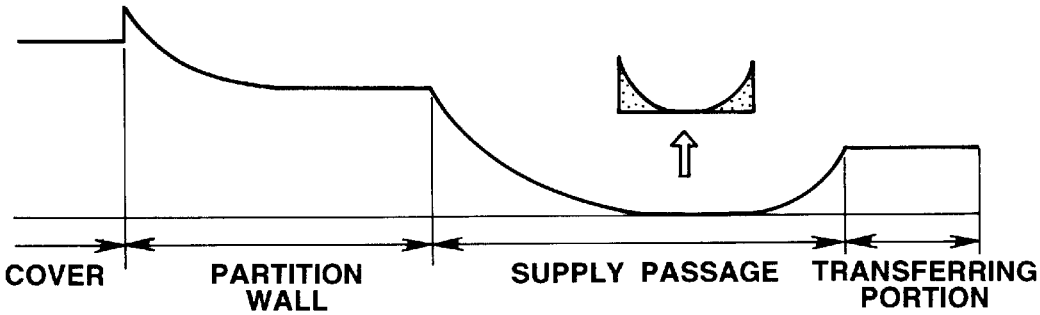
FIG. 3C is a schematic view showing change in the liquid level of ink.
Figure 3D:
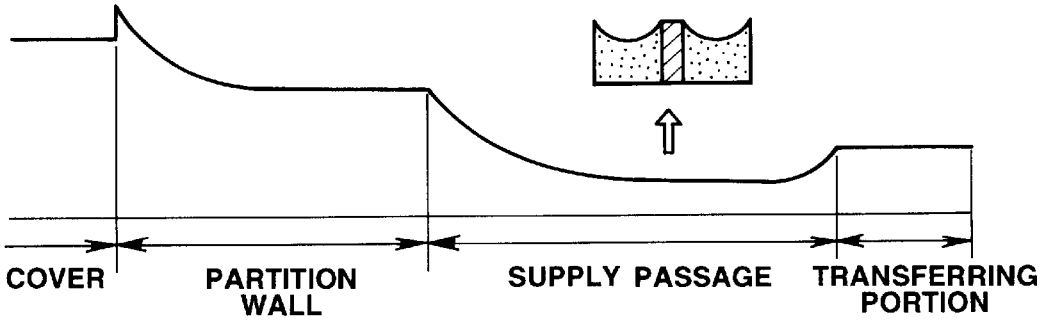
FIG. 3D is a schematic view showing change in the liquid level of ink.

If the sub-wall is not provided to the supply passage S adjacent to each of the transfer portions T as shown in FIG. 2B, distance $d_1$ between a pair of the partition walls 47*a* for defining the supply passage S is wide. The above-mentioned state shown in FIG. 3B is realized at an intermediate position of the supply passage S. Therefore, supply of ink to the transfer portions T is sometimes interrupted. That is, as indicated with change in the liquid level at each position in the ink supply passage shown in FIG. 3C, ink is supplied from an ink supply passage having the cover to the supply passage S through an ink supply passage having no cover and formed by only the partition walls made of the sheet resist. Since the supply passage has a large width, an ink breakpoint is formed between the supply passages S and the transfer portions T. As a result, supply of ink to the transfer portions T is sometimes interrupted.

Therefore, the first embodiment has the structure incorporating the sub-walls 47*c* at substantially the central portion of a pair of the partition walls 47*a* which define each of the supply passages S, as shown in FIGS. 1 and 2A. Since the above-mentioned sub-walls 47*c* are provided, distance $d_2$ between the sub-wall 47*c* and the partition wall 47*a* is made to be shorter than half of the distance $d_1$ between the pair of the partition walls 47*a* in a case in which the sub-wall 47*c* is not provided, as shown in FIG. 2A. Therefore, as shown in FIG. 3 (*d*), the liquid level of ink is raised at an intermediate position of the supply passage S. As a result, continuous supply of ink to the transfer portions T can be performed.

Actually, a printer head was prototyped in which the columnar member 47*b* is not provided for the transfer portion to vary the height of the partition walls 47*a* so as to measure base width x (see FIG. 3B) of ink from the partition wall 47*a*. Thus, results as shown in Table 1 were obtained. Note that the distance between the pair of the partition walls 47*a* in the supply passage S was about 60 μm.

TABLE 1

| Height of Partition Wall | Base Width x of ink |
|---|---|
| about 3.0 μm | about 7.6 μm |
| about 4.7 μm | about 20.7 μm |
| about 7.2 μm | about 30 μm or longer |

When the height of the partition walls 47*a* was about 7.2 μm, no ink breakpoint was formed from the supply passages S to the transfer portions T. Therefore, accurate measurement of x was impossible. The height h' of the liquid level at the point at which ink is brought into contact with the partition wall (therefore, the base width x) should be constant regardless of the height of the partition wall. However, the structure for use in the above-mentioned experiments is formed such that the portion of the supply passages S opposite to the transfer portions T are connected to the ink passage formed into the tunnel shape in which the liquid level is high (about 25 μm). Therefore, the ink liquid level, and the base width x of ink are changed in accordance with the height of the partition walls 47*a*.

As can be understood from the results shown in Table 1, when the height of the partition walls 47*a* is made to be, for example, about 5 μm, the columnar members 47*b* and the sub-walls 47*c* are required to be provided such that the distance from the partition walls 47*a* is shorter than the 20 μm×2=40 μm. Since the surface tension of ink actually has a negative temperature dependency it is preferable that the distance is shorter than the above-mentioned value.

When the heights of the partition walls 47*a* and the columnar members 47*b* are enlarged, ink supply can advantageously be performed. However, the liquid level of ink is raised in the vaporizing portion, causing the quantity of ink to be enlarged. Therefore, energy required to vaporize ink is enlarged. Moreover, there arises a problem in that the $SiO_2$ film 47 cannot easily be formed and etched. Therefore, it is preferable from a practical viewpoint that the heights of the partition walls 47*a* and the columnar members 47*b* are about 5 μm to about 6 μm.

Ink 8 for use in the printer head 1 according to the first embodiment is composed of dye, solvent and additives which are added if necessary. To optimize the transfer sensitivity, thermal stability, the quality of a formed image and preservation stability, the materials and mixture ratio of the materials are determined.

The solvent of ink must have a melting point which is lower than 50° C. and a boiling point which is 250° C. or higher and lower than 500° C. Moreover, the solvent must have a thermal decomposition temperature which is higher than the boiling point. If solvent having a melting point of 50° C. or higher is employed, there is apprehension that ink prepared by mixing the solvent and dye with each other is coagulated when, for example, ink is preserved at room temperature. If the boiling point of the solvent is lower than 250° C., there is apprehension that only the solvent is selectively volatilized in a portion of the printer head positioned adjacent to the transfer portion and exposed to the air. If the boiling point of the solvent is 500° C. or higher, the ink vaporizing efficiency deteriorates and, therefore, the transfer sensitivity deteriorates. To this extent, there is apprehension that the thermal decomposition process undesirably proceeds before ink is vaporized. It is preferable that the molecular weight of the solvent is 450 or smaller. If the molecular weight is too large, the expansion coefficient during the vaporization is reduced excessively and, therefore, a problem occurs because the transfer sensitivity deteriorates. It is preferable that the solvent has a characteristic whereby the solvent is spontaneously absorbed in the fibers in art paper from a viewpoint of performing transfer to plain paper.

To dissolve dye in the foregoing solvent by 5 wt % or more, it is preferable that the solubility parameter (defined by J. H. Hildebrand) of the solvent at 25° C. ranges from about 7.5 to about 10.5. If the solubility parameter is larger than about 10.5, the solubility of the dye is reduced excessively. As such there is concern that water in air is absorbed. This reducing the reproducibility of the transfer sensitivity. If the solubility parameter is smaller than 7.5, there is concern that also the solubility of the dye is reduced excessively. It is preferable that the solvent has a flash point of 150° C. or higher, the toxicity for the human body is low and the solvent is a colorless material.

Materials which can be employed as the foregoing solvent are exemplified by: ester phthalate, such as dimethyl phthalate, diethyl phthalate, dibutyl phthalate, isobutyl phthalate, dihexyl phthalate, diheptyl phthalate, dioctyl phthalate or di-isodecyl phthalate; dibasic fatty acid ester, such as dibutyl sebacate, dioctyl sebacate, dioctyl adipate, di-isodecyl adipate, dioctyl azelate or dioctyl tetrahydrophthalate; phosphoric ester, such as tricresyl phosphate or trioctyl phosphate; an organic compound, such as acetyl tributyl citrate or butyl phthalyl butyl glycolate, which is generally called a plasticizer for plastic; and an organic compound prepared by combining an aromatic ring, such as ethyl naphthalene, propyl naphthalene, hexyl naphthalene or octyl benzene, and an alkyl chain.

The dye to be contained in ink has a boiling point which is about 250° C. or higher and lower than about 500° C. Moreover, the thermal decomposition temperature of the dye must be higher than the boiling point. If the boiling point of the dye is lower than about 250° C., there is apprehension that the transfer member, such as paper, is contaminated because a portion of ink is vaporized when the printer head has been previously heated. If the boiling point of the dye is 500° C. or higher, the dye vaporization efficiency deteriorates and, therefore, the transfer sensitivity deteriorates. Moreover, there is a concern that the thermal decomposition process proceeds before ink is vaporized. It is preferable that the dye has an appropriate hue as a process color, a molar extinction coefficient of about 10000 or greater, low toxicity for the human body and excellent resistance against light in a state of coexistence with the foregoing solvent.

It is preferable that the dye has a solubility parameter at 25° C. which ranges from about 7.5 to about 10.5 and a vaporization rate of about $1\times10^{-4}$ g/m$^2$ sec or higher. Moreover, it is preferable that the residual component which is not vaporized under the above-mentioned conditions is about 0.1% or lower. If the solubility parameter of the dye does not satisfy the foregoing range, the dye cannot be dissolved in the above-mentioned solvent by 5 wt % or more. If the heat resistance of the dye is unsatisfactory or if the dye contains a nonvolatile impurities in a large quantity and the ratio of the residual component when the dye has been heated at 200° C. is about 0.1% or higher, degraded substances are undesirably accumulated in the ink holding structure of the transfer portion. Thus, there arises an apprehension that clogging of the printer head occurs.

The dye may be dicyanostyryl yellow dye suggested by the applicant of the present invention in Japanese Patent Laid-Open No. 8-244363, Japanese Patent Laid-Open No. 8-244364 and Japanese Patent Laid-Open No. 8-244366 and having a general formula shown in [Chemical Formula 1]; tricyanostyryl magenta dye having a general formula shown in [Chemical Formula 2]; or anthraquinone cyan dye having a general formula shown [Chemical Formula 3].

[Chemical Formula 1]

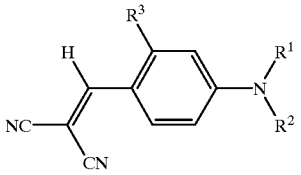

$R^1, R^2 =$ —$C_2H_5$, —$C_4H_9$(n), —$C_4H_9$(i), —$C_6H_{13}$(n), —$CH_2$—$CH(C_2H_5)$—$C_4H_9$(n)

$R^1 = R^2$ or $R^1 \neq R^2$ $R^3 =$ —H, —$CH_3$, —$OCH_3$,

-continued

[Chemical Formula 2]

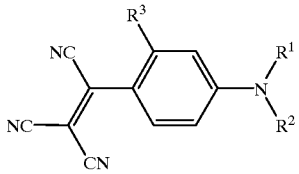

$R^1, R^2 =$ —$C_2H_5$, —$C_4H_9$(n), —$C_4H_9$(i), —$C_6H_{13}$(n), —$CH_2$—$CH(C_2H_5)$—$C_4H_9$(n)

$R^1 = R^2$ or $R^1 \neq R^2$ $R^3 =$ —H, —$CH_3$, —$OCH_3$,

[Chemical Formula 3]

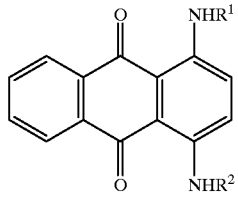

$R^1, R^2 =$ —$C_2H_5$, —$C_3H_7$(n), —$C_3H_7$(i), —$C_4H_9$(n), —$C_4H_9$(i), —$C_6H_{13}$(n), —$CH_2$—$CH(C_2H_5)$—$C_4H_9$(n), 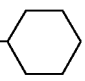 , —CH($C_3H_7$(n))($C_3H_7$(n))

$R^1 = R^2$ or $R^1 \neq R^2$

To reduce the residual component after the dye has been heated to, for example, 200° C. in air to be 0.1% or lower, it is preferable that the dye is refined by a sublimation refining method, a re-crystallization method, a zone melting method or a column refining method before the dye is used.

To adjust the physical properties of ink, appropriate additives, such as a surface active agent and a viscosity adjustment material, may be added. Note that the additives must have boiling points similar to those of the solvent and the dye. As the surface active agent, for example, fluoridated fatty acid ester or silicon oil may be employed.

Ink is prepared by dissolving, at a temperature of 50° C. or lower, the foregoing dye in the above-mentioned solvent by 5 wt % or higher, preferably 10 wt % or higher and more preferably 20 wt % or higher. To raise the solubility, two or more types of dye materials may be mixed with each other. If necessary, the additives are added. To efficiently supply ink to the transfer portion by dint of the capillary phenomenon, it is preferable that the surface tension is 15 mN/m or greater at 25° C.

Paper suitable to the above-mentioned structure of the printer is plain paper, such as PPC paper, or bond paper, such as art paper. To obtain a high-quality image having a satisfactory gradient and density, dedicated paper may be employed which is coated with polyester, polycarbonate, acetate, CAB, polyvinyl chloride or the like which is resin for enhancing color development of disperse dye or the oil soluble dye. To efficiently raise ink absorbing rate, for example, porous pigment, such as silica or alumina, may be added.

Figure 23:
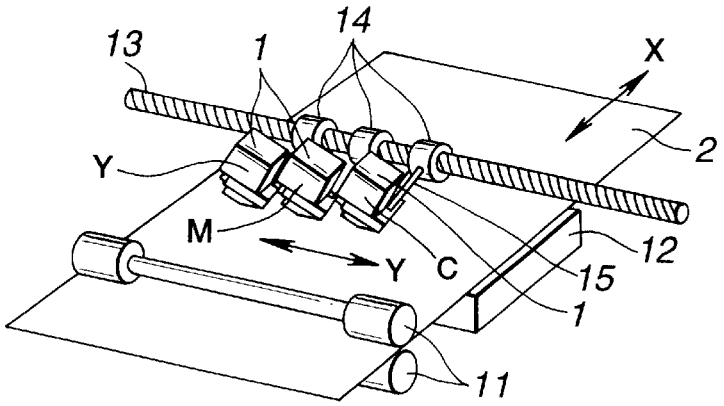
FIG. 23 is a schematic view showing the structure of a serial color printer.
Figure 24:
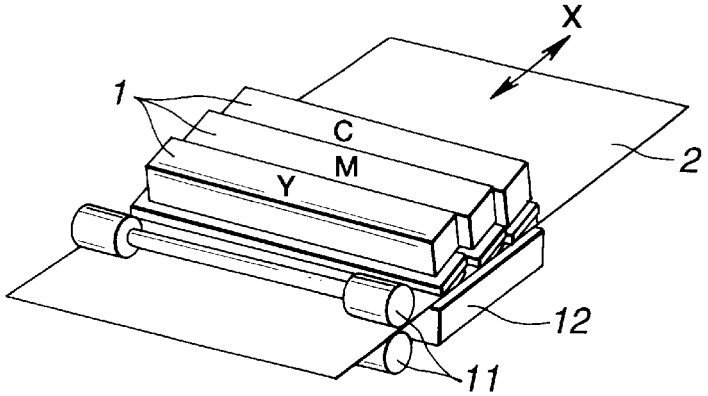
FIG. 24 is a schematic showing the structure of a line color printer.
Figure 25:
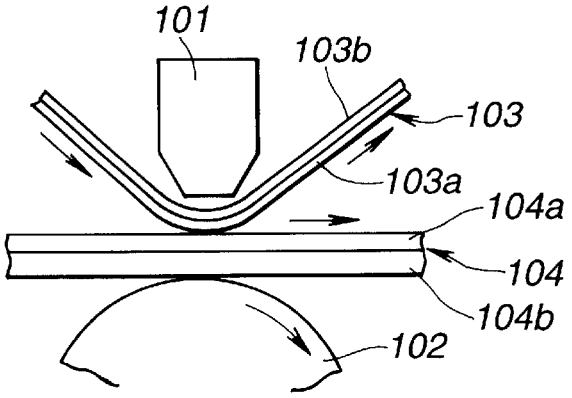
FIG. 25 is a schematic view showing the structure of a conventional sublimation thermal transfer printer.

FIGS. 23 and 24 show examples in which the printer head according to the first embodiment is applied to a serial printer and a line printer.

In the case of the serial printer shown in FIG. 23, printer heads 1 for yellow (Y), magenta (M) and cyan (C) are disposed in a direction (direction Y shown in the drawing) perpendicular to a direction (direction X shown in the drawing) in which the paper sheet 2 is fed. Note that a printer head for printing a black image may be added. For example, each printer head 1 is, through a connection member 15, secured to a movable member 14 joined to a feeding shaft 13. When the feeding shaft 13 has been rotated by a power source (not shown), each printer head 1 reciprocates in the direction Y shown in the drawing. On the other hand, the paper sheet 2 is fed in the direction X by the feeding roller 11 whenever each printer head 1 scans one line. Then, each printer head 1 performs a printing operation at a position between each printer head 1 and a platen 12.

In a case of the line printer shown in FIG. 24, printer heads 1 extending in a direction (a line direction) perpendicular to a direction (the direction X shown in the drawing) in which the paper sheet 2 is fed are disposed to correspond to yellow (Y), magenta (M) and cyan (C). As a matter of course, a printer head for printing a black image may be added. The paper sheet 2 is, by a feeding roller 11, fed in the direction X shown in the drawing so that printing in line units is performed by each printer head 1 at a position between each printer head 1 and the platen 12.

As shown in FIGS. 1 and 2A, the printer head according to the first embodiment incorporates the ink-level holding means having the sub-walls 47*c* and disposed in the supply passage S adjacent to the transfer portions T. Thus, a breakpoint of ink in the supply passages S can be prevented. Therefore, replenishment of ink consumed in the transfer portions T can reliably be performed by only the spontaneous flow of ink. As a result, occurrence of a defect in a printing operation caused from interruption of ink can be prevented.

Second Embodiment

Figure 12:
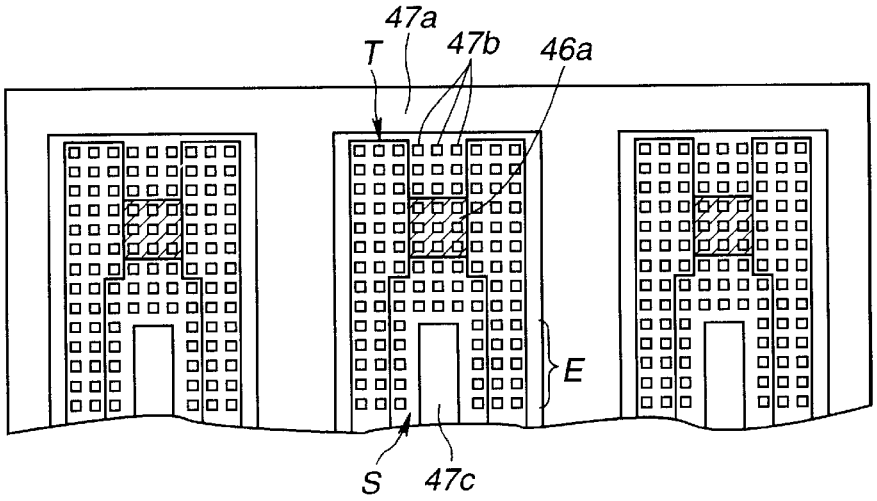
FIG. 12 is an enlarged schematic plan view showing a portion including transfer portions of a printer head according to a second embodiment of the present invention.

FIG. 12 shows the structure of a portion including a transfer portions of a printer head according to a second embodiment of the present invention.

In the second embodiment, a structure similar to that according to the first embodiment shown in FIG. 2 is employed. As shown in FIG. 12, the pattern of the ink holding structure provided for each of the transfer portions T and formed by the columnar members 47*b* is extended to a position between a pair of the partition walls 47*a* for defining the supply passage S and the sub-wall 47*c*.

Therefore, the columnar members 47*b* disposed in an extended portion E enable the ink level even in the supply passages S to be maintained at the height which is substantially the same as the transfer portion T. Therefore, a quantity of ink which must be held in the supply passages S can be increased. Thus, ink can be reliably be supplied to the transfer portions T.

Third Embodiment

Figure 13:
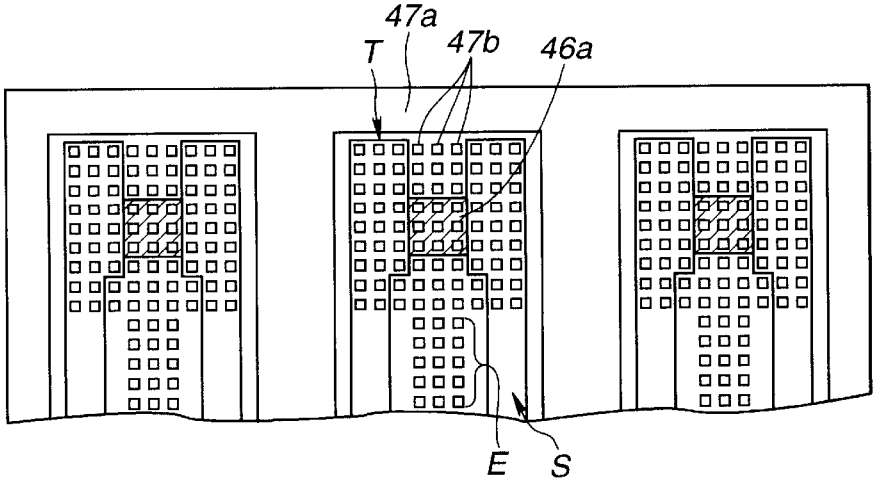
FIG. 13 is an enlarged schematic plan view showing a portion including transfer portions of a printer head according to a third embodiment of the present invention.

FIG. 13 shows the structure including the transfer portions of a printer head according to a third embodiment of the present invention.

In the third embodiment, the sub-walls according to the first embodiment shown in FIG. 2 are constituted by the extended portion E of the pattern of the ink holding structure disposed in the transfer portion T and formed by the columnar members 47*b*, as shown in FIG. 13.

The foregoing structure enables the ink level in the portions of the supply passages S corresponding to the sub-walls according to the first embodiment to be maintained at substantially the same height as that in the transfer portion T. The ink level can be raised also in the portions corresponding to the sub-wall and the partition walls 47*a*.

Fourth Embodiment

Figure 14:
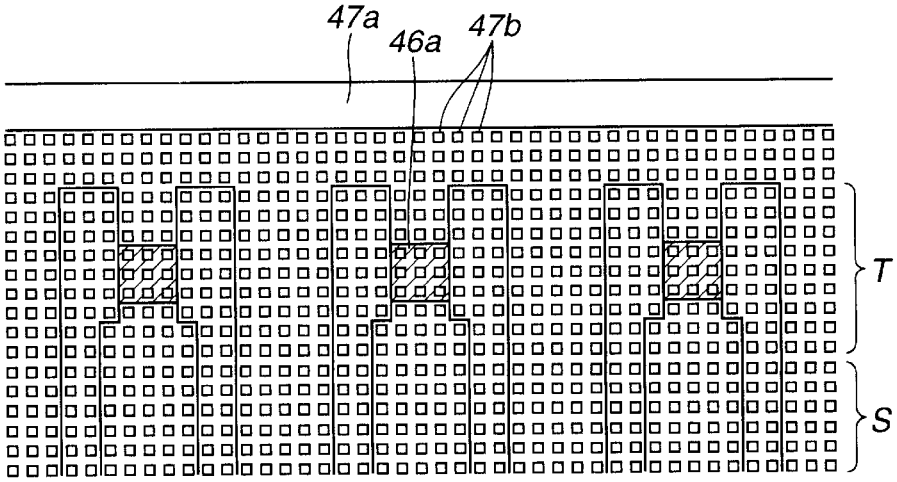
FIG. 14 is an enlarged schematic plan view showing a portion including transfer portions of a printer head according to a fourth embodiment of the present invention.

FIG. 14 shows the structure including the transfer portions of a printer head according to a fourth embodiment of the present invention.

As shown in the drawing, the fourth embodiment has the structure that the portions including the transfer portions T of the printer head are fully provided with the patterns of the ink holding structures formed by the columnar members 47*b* including the partition walls 47*a* and the supply passages S. The partition walls 47*a* are provided for only the front portion of the transfer portion T.

In this embodiment, a wide area including the transfer portions T and the supply passages S is able to hold ink. Therefore, a large quantity of ink can be held. Since ink is basically able to flow regardless of the direction, ink replenishment can flexibly be performed. Therefore, interruption of ink supply in each of the transfer portions T can be reliably prevented. In addition a large quantity of ink is not used wastefully. Thus, there arises a problem in that residual ink causes clogging to easily occur.

Fifth Embodiment

Figure 15:
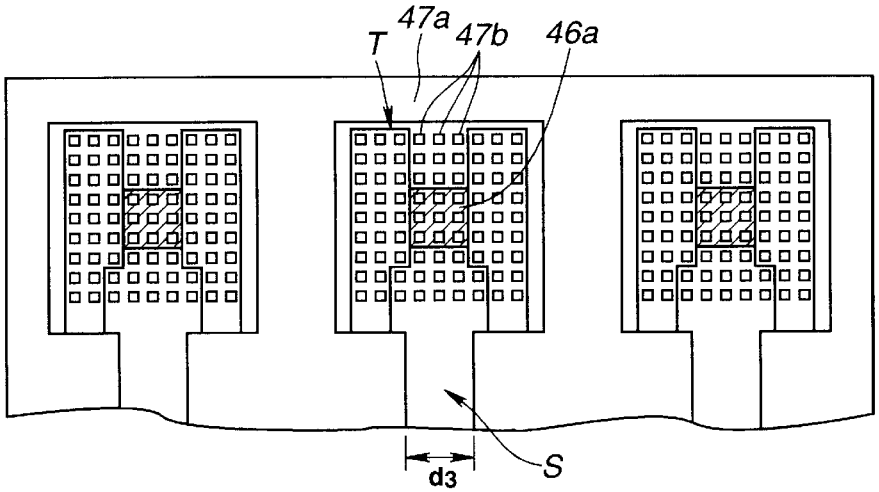
FIG. 15 is an enlarged schematic plan view showing a portion including transfer portions of a printer head according to a fifth embodiment of the present invention.

FIG. 15 shows the structure including the transfer portions T of a printer head according to a fifth embodiment of the present invention.

In the fifth embodiment, the width of each of the supply passages S adjacent to the transfer portions T is reduced as shown in the drawing to maintain the ink level in the small width portions. If the widths of the supply passages S are reduced excessively, there is apprehension that the absolute quantity of ink which must be held in the supply passages S is undesirably reduced. In this case, the flow of ink cannot satisfactorily be performed. Therefore, it is preferable that the width $d_3$ of each of the supply passages S is about 40 $\mu$m or greater.

Sixth Embodiment

Figure 16:
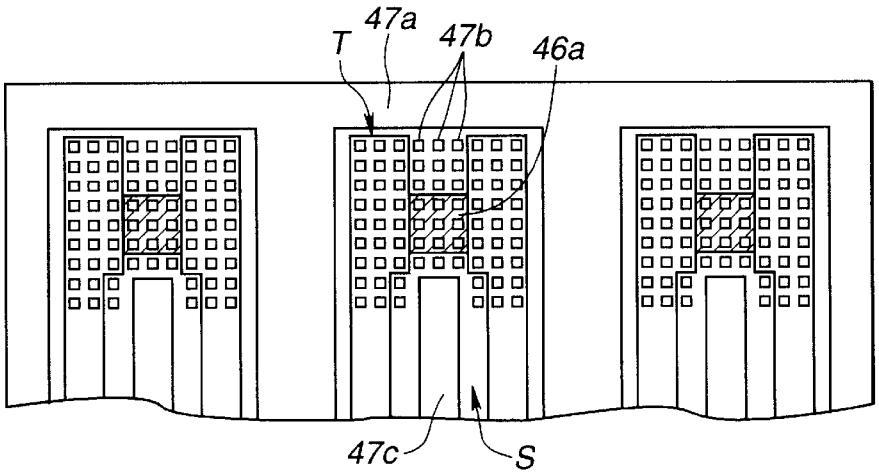
FIG. 16 is an enlarged schematic plan view showing a portion including transfer portions of a printer head according to a sixth embodiment of the present invention.

FIG. 16 shows the structure of portions including the transfer portions of a printer head according to a sixth embodiment of the present invention.

The sixth embodiment has a similar structure to that according to the first embodiment shown in FIG. 2. As shown in FIG. 16, the leading end portions of the sub-walls 47*c* are disposed adjacent to the heater portions 46*a* formed in the transfer portions T as much as possible. In the foregoing case, it is preferable that at least one line of columnar members 47*b* is, in the transfer portion T, disposed between the vaporizing portion formed immediately above the heater portion 46*a* and the sub-walls 47*c*. As a result, replenishment of ink consumed in the vaporizing portion can satisfactorily be performed.

Seventh Embodiment

Figure 17:
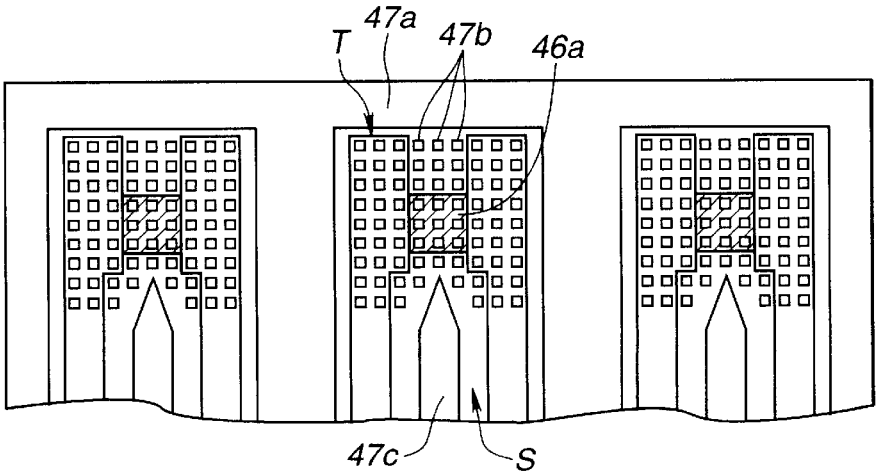
FIG. 17 is an enlarged schematic plan view showing a portion including transfer portions of a printer head according to a seventh embodiment of the present invention.

FIG. 17 shows the structures including the transfer portions of a printer head according to a seventh embodiment of the present invention.

The seventh embodiment has a structure similar to that according to the sixth embodiment shown in FIG. 16. As shown in FIG. 17, the leading end of the sub-walls 47*c* is formed into a tapered shape. As a result, ink flow to the vaporizing portion can be smoothed and, therefore, ink supply can satisfactorily be performed.

Eighth Embodiment

Figure 18:
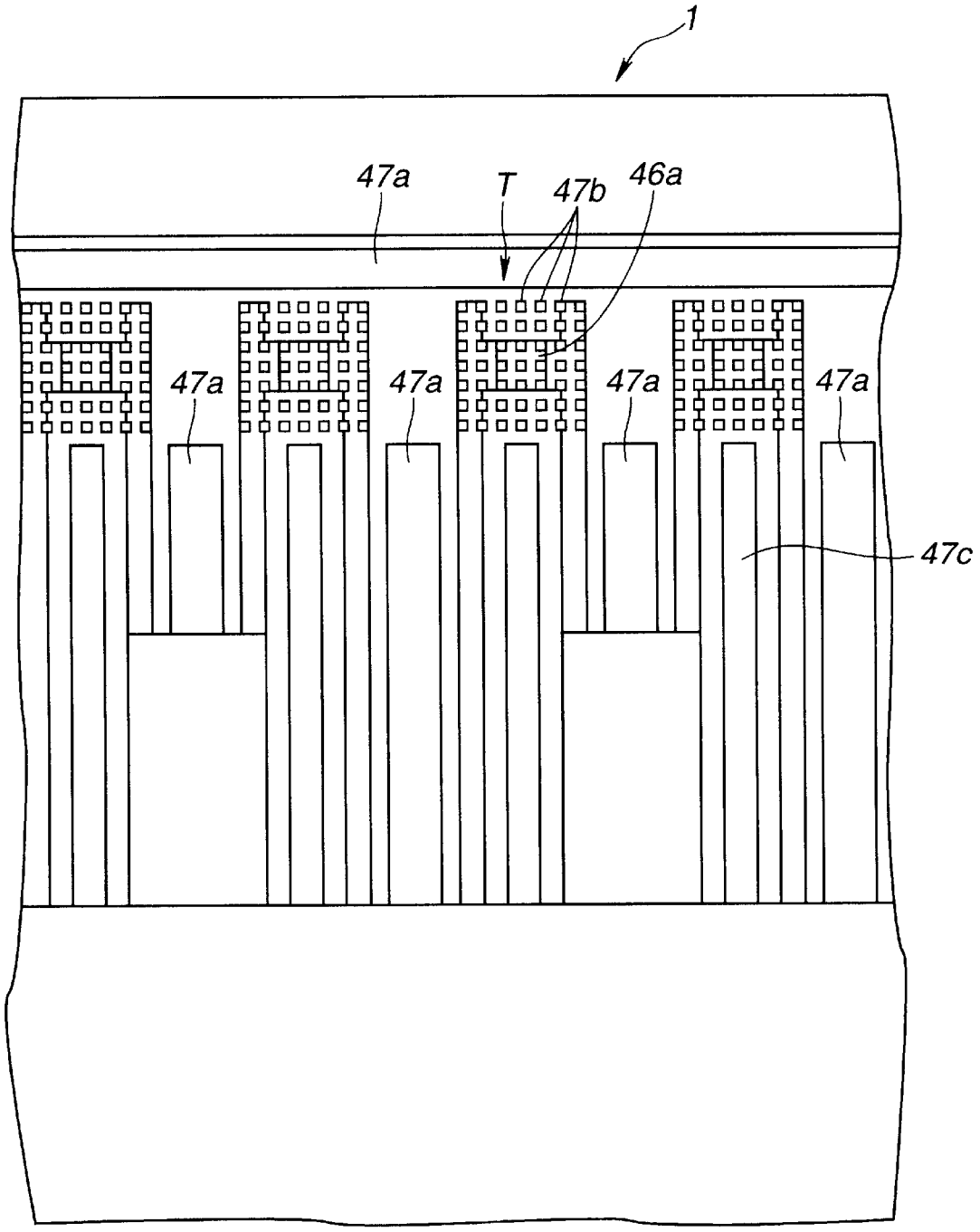
FIG. 18 is an enlarged schematic plan view showing a portion including transfer portions of a printer head according to an eighth embodiment of the present invention.

FIG. 18 shows structures of transfer portions of a printer head according to an eighth embodiment of the present invention.

The eighth embodiment has a structure similar to that of the first embodiment shown in FIG. 1. As shown in FIG. 18, the partition walls 47*a* between the transfer portions T are omitted to communicate the transfer portions T to one another. As a result of the above-mentioned structure, ink is able to flow among the adjacent transfer portions T. If an ink supply passage for a certain transfer portion T has a defect and, therefore, ink supply to the transfer portion T cannot be performed, ink can be supplied from the adjacent transfer portion T to the transfer portion T that encountered the problem. Therefore, a defect in a printing operation can be prevented.

According to the above embodiments, a predetermined level of ink 8 can be maintained in the supply passages S adjacent to the transfer portions T. Therefore, only a spontaneous flow of ink 8 enables ink to reliably and smoothly be supplied from the supply passages S to the transfer portions T. Therefore, irregular densities caused from insufficient supply of ink 8 to the transfer portion and formation of a white line during a printing operation caused from interruption of ink 8 to the transfer portions T can be prevented.

Referring to FIGS. 19 to 22, ninth to eleventh embodiments of the present invention will now be described.

Figure 19A:
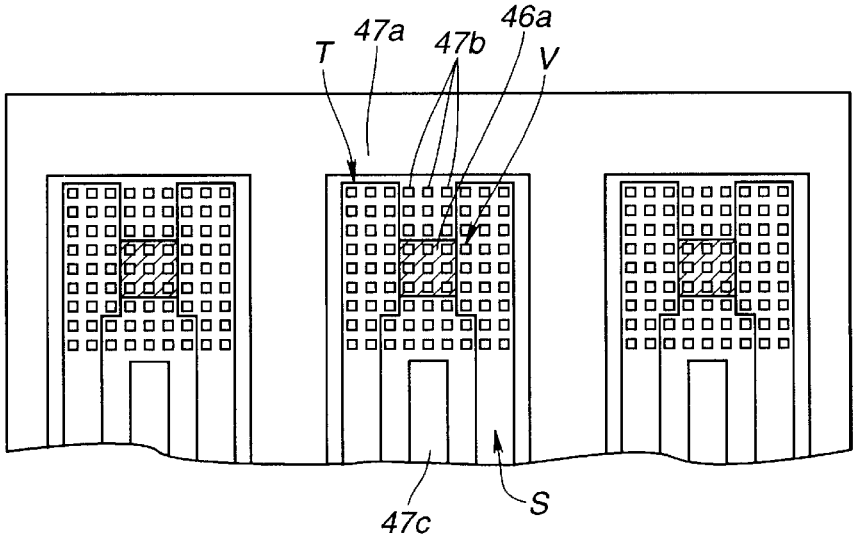
FIG. 19A is an enlarged schematic plan view and a cross sectional view showing a portion including transfer portions of the printer head according to the first embodiment of the present invention.
Figure 19B:
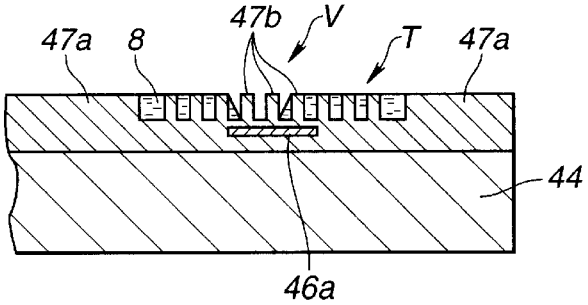
FIG. 19B is an schematic plan view and a cross sectional view showing a portion including transfer portions of the printer head according to the first embodiment of the present invention.

If the columnar members 47*b* are, as shown in FIG. 19A, arranged in the vaporizing portion V immediately above the heater portion 46*a* in the transfer portion T similar to the other portion of the transfer portion T, ink 8 is not substantially present in the central portion of the vaporizing portion V, as shown in FIG. 19B. A major portion of vaporization of ink 8 takes place in the boundaries of the vaporizing portion V. In the central portion of the heater portion 46*a*, the temperatures are higher than those of the adjacent portions. Therefore, irregularity in the surface tension caused from the distribution of the temperatures causes ink 8 in the central portion of the heater portion 46*a* to be moved outwards. As a result, substantially no ink 8 is present in the central portion of the vaporizing portion V.

Figure 19C:
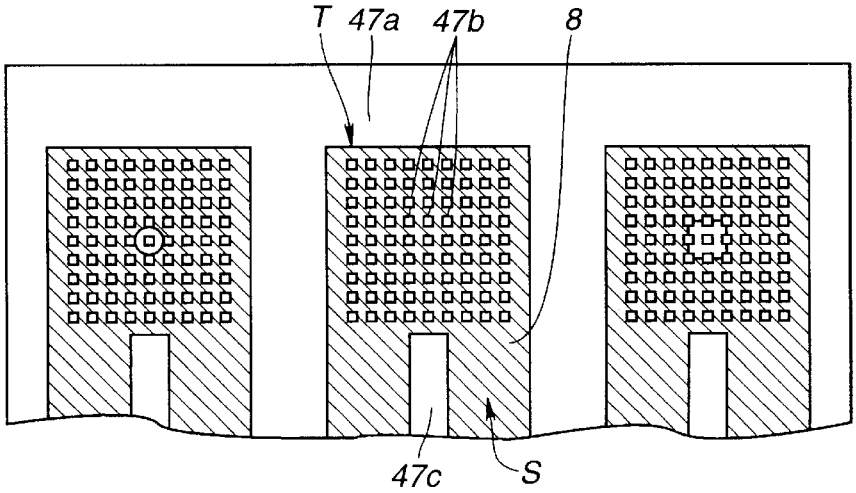
FIG. 19C is an enlarged schematic plan view and a cross sectional view showing a portion including transfer portions of the printer head according to the first embodiment of the present invention.

If the surface characteristic of the columnar members 47*b* is changed owning to adhesion of degraded substances caused by heat and thus the wettability with ink 8 is improved, ink 8 is introduced into the central portion of the vaporizing portion V as in the central transfer portion T shown in FIG. 19C. Therefore, the transfer sensitivity in the foregoing transfer portion T is rapidly raised. As shown in the foregoing drawing, the leading ends of the ink 8, that is introduced into the vaporizing portion V that is, the area and the circumferential length of the portions in which ink 8 is not present are non-uniform.

If the degree of ink 8 introduced into the vaporizing portion V in the transfer portions T varies, irregularity in density occurs between the printed pixels. Therefore, the quality of the printed image deteriorates. If the leading end of the ink 8 introduced in each of the transfer portions T has not reproduced, the transfer sensitivity characteristic (the gamma characteristic) of each of the transfer portions T becomes instable. Thus, density irregularity occurs.

The following embodiments overcome the above-mentioned problem.

Ninth Embodiment

FIG. 20 shows the structures including the transfer portions of a printer head according to the ninth embodiment of the present invention. In the ninth embodiment, the vaporizing portion V of each of the transfer portions T has the structure in which a predetermined number of the columnar members 47*b* are omitted from an original configuration pattern, as illustrated.

Figure 20A:
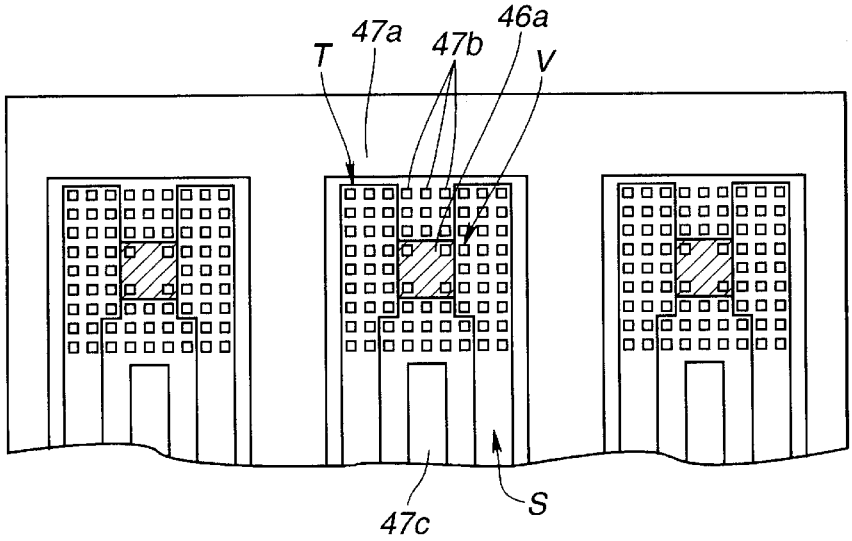
FIG. 20A is an enlarged schematic cross sectional view showing a portion including transfer portions of a printer head according to a ninth embodiment of the present invention.
Figure 20B:
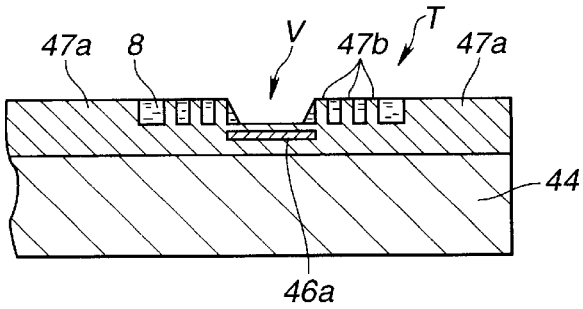
FIG. 20B is a cross sectional view showing a portion including transfer portions of a printer head according to a ninth embodiment of the present invention.
Figure 20C:
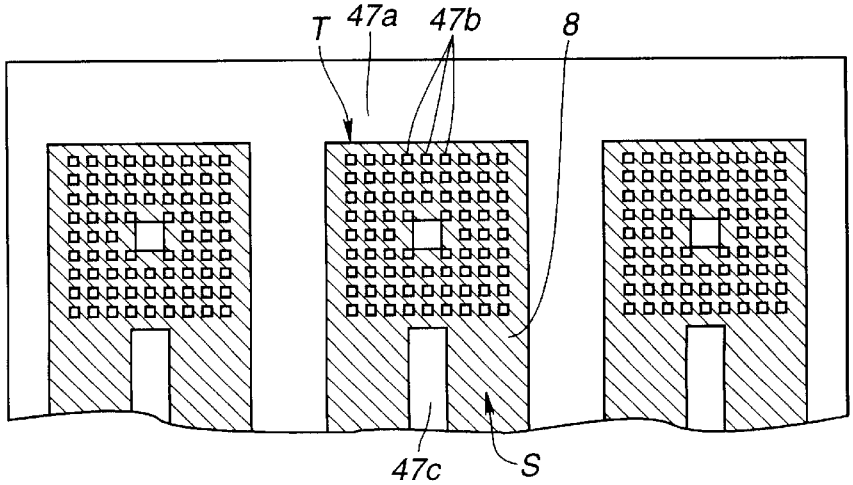
FIG. 20C is an enlarged schematic cross sectional view showing a portion including transfer portions of a printer head according to a ninth embodiment of the present invention.

That is, the original configuration pattern has 3×3 columnar members 47*b* disposed in a somewhat inner portion above the heater portion 46*a*, as shown in FIG. 19. In the ninth embodiment, five central columnar members 47*b* are omitted while four columnar members 47*b* at the four corners are left, as shown in FIG. 20A. As a result, a relatively large gap is formed in the central portion of the vaporizing portion V. Thus, ink 8 is not substantially supplied to the central portion of the vaporizing portion V, as shown in FIGS. 20B and 20C. On the other hand, a predetermined height of ink 8 can be maintained in the boundaries with the vaporizing portion V by the columnar members 47*b*. Therefore, uniform transfer is always performed.

As described above, supply of ink 8 to the central portion of the vaporizing portion V in each of the transfer portions T is intentionally inhibited. Thus, the leading ends of the introducted ink 8 are always constant in any one of the transfer portions T, as shown in FIG. 20C. Also the reproduction of each of the transfer portions T can be improved. As a result, density irregularity of a printed image can significantly be prevented.

Tenth Embodiment

FIG. 21 shows the structures including transfer portions of a printer head according to the tenth embodiment of the present invention. The tenth embodiment has a structure that the configuration pattern of the columnar members 47*b* in the vaporizing portion V and its adjacent portion are made to be different from the other portions, as illustrated.

That is, the basic configuration pattern of the columnar members 47*b* in each of the transfer portions T is formed into a 9×9 matrix. In the vaporizing portion V above the heater portion 46*a*, four columnar members 47*b* are disposed at a pitch greater than the pitch in the basic configuration pattern. Moreover, four central columnar members 47*b* among the nine columnar members 47*b* adjacent to the four sides of the vaporizing portion V are shifted toward the vaporizing portion V to adjust the intervals from the four columnar members 47*b* in the vaporizing portion V.

Also, the above-mentioned structure enables a relatively large gap to be formed in the central portion of the vaporizing portion V. Therefore, ink 8 is not substantially supplied to the central portion of the vaporizing portion V, as shown in FIG. 21B. On the other hand, a predetermined level of ink 8 is maintained by the columnar members 47*b* in the boundaries of the vaporizing portion V. Therefore, uniform transfer is always performed.

Eleventh Embodiment

Figure 22A:
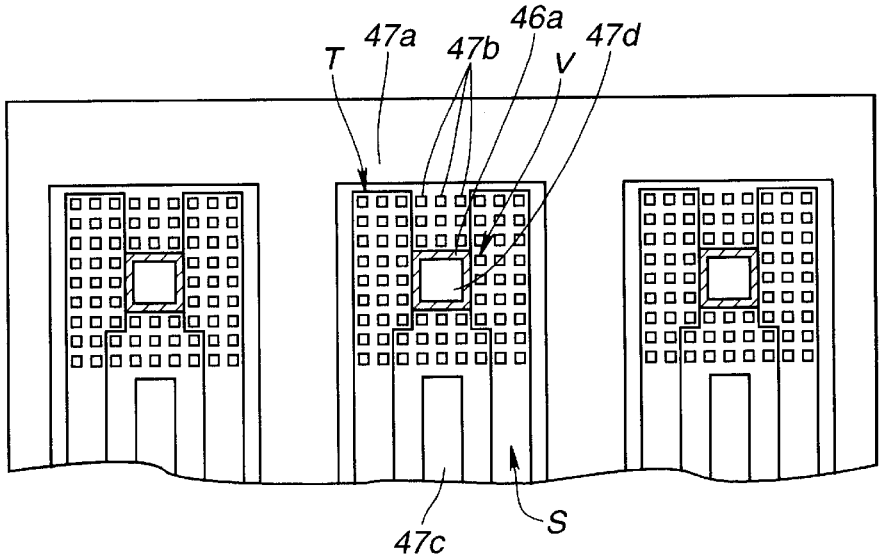
FIG. 22A is an enlarged schematic plan view showing a portion including transfer portions of a printer head according to an eleventh embodiment of the present invention.
Figure 22B:
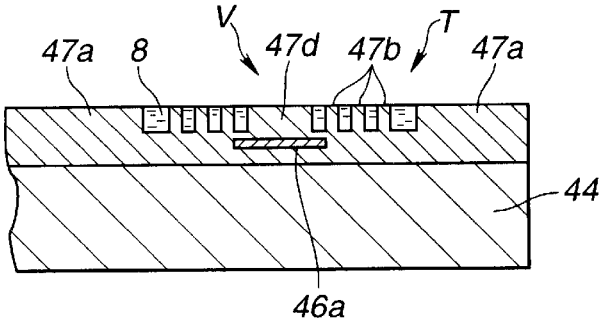
FIG. 22B is a cross sectional view showing a portion including transfer portions of a printer head according to an eleventh embodiment of the present invention.
Figure 22C:
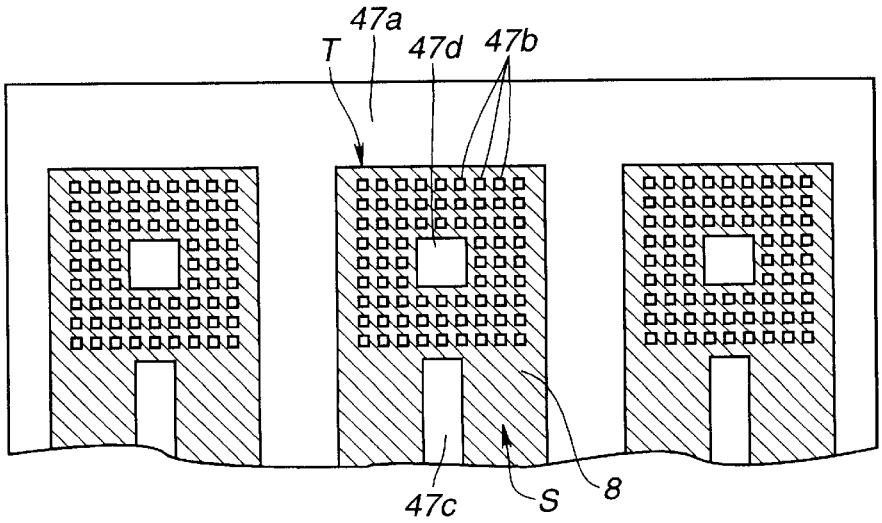
FIG. 22C is an enlarged schematic plan view showing a portion including transfer portions of a printer head according to an eleventh embodiment of the present invention.

FIG. 22 shows the structures of transfer portions of a printer head according to the eleventh embodiment of the present invention. In the eleventh embodiment, a rectangular columnar member 47*d* larger than the other columnar members 46*b* and having a cross sectional shape which is somewhat smaller than the size of the heater portions 46*a* is provided in the central portion of the vaporizing portion V, as shown in FIG. 22A.

Therefore, the outer wall of the columnar member 47*d* serves as an ink-introduction inhibition wall for inhibiting the introduction of ink 8 into the central portion of the vaporizing portion V. Moreover, a predetermined height of ink 8 is maintained between the outer wall and the adjacent columnar members 47*b*. Therefore, uniform transfer is always performed.

Note that the columnar member 47*d* may have a hollow cross sectional shape having a gap in the central portion thereof.

In the ninth to eleventh embodiments, the sub-walls 47*c* provided for the inside portion of the supply passages S enable effects similar to those obtainable from the first embodiment to be obtained. In the ninth to eleventh embodiments, vaporization of ink 8 takes place in only the peripheral portions of the vaporizing portion V. Therefore, ink 8 cannot easily be introduced into the central portion of the vaporizing portion V or ink 8 cannot be introduced into the same. Therefore, a predetermined quantity of ink which must be vaporized in the vaporizing portion V can always be maintained. Therefore, change in the quantity of ink which occurs as time elapses can be prevented. As a result, density irregularity between the pixels can be prevented when a printing operation is performed. Therefore, deterioration in the quality of a printed image which takes place as time elapses can be prevented.

In the above-mentioned structures, discharge of ink which takes place when ink is heated by the heater is caused by vaporization or ablation. Ink may be discharged by dint of a flow of ink (Marangoni flows or surface tension convection) caused from a gradient of surface tensions or a gradient of the interfacial tension generated by heat of the heater.

When ink is discharged by dint of the above-mentioned principle, the structure is formed such that the temperatures of ink in the transfer portions are distributed after the heater has been heated. If the heater of the above-mentioned structure is heated, heat of the heater is conducted to ink. Thus, the surface tension of ink adjacent to the heater is reduced. As a result, ink adjacent to the heater is attracted by ink (that is, ink having a high temperature and a high surface tension) positioned away from the heater. Therefore, a progressive wave which outwards propagates from the position above the heater is generated in ink. When the progressive wave conflicts with the wall which is holding ink, the component of velocity of the progressive wave is converted into an upward component. As a result, a portion of ink is discharged as a liquid droplet.

When interruption of heating using the heater has caused the temperature of ink to be lowered, the above-mentioned difference in the surface tension disappear. Thus, the original state of the liquid level is returned, causing a progressive wave which is propagated in an opposite direction to the direction of the above-mentioned progressive wave to be generated in ink. The generated progressive wave is propagated toward the position immediately above the heater. When the generated progressive waves conflict with each other at the position above the central portion of the heater, the components of velocities of the progressive waves are converted into upward components. As a result, a portion of ink is discharged as a liquid droplet.

When a gradient of the surface tension of ink or that of the interfacial tension is generated by heat of the heater to use a caused ink flow so as to discharge ink, a relatively large ink droplet can be discharged as compared with the structure for discharging ink by vaporization or ablation. Therefore, the transfer sensitivity per unit hour can be improved and, therefore, recording can be realized with excellent transfer sensitivity and transfer speed.

The method of discharging ink by using the ink flow caused from the gradient of the surface tension or that of the interfacial tension is an efficient method. As compared with the structure for discharging ink by using only the vaporization or the ablation, energy which must be supplied to heat ink can be reduced to about ½ to about ⅓.

Examples of the present invention will now be described.

Example 1

The structure according to the first embodiment was employed so that a printer head having the transfer portions T having the columnar members disposed as shown in FIGS. 1 and 2A was manufactured. Each of the columnar members 47*b* was formed into a rectangular parallelopiped having a size about 3 μm×about 3 μm and a height of about 6 μm. The columnar members 47*b* were disposed into a 9×9 square matrix in which the intervals of the centers of the columnar members 47*b* were about 6 μm. The adjacent transfer portions T were isolated from one another by partition walls 47*a* having a height of about 6 μm which was substantially the same as that of each of the columnar members 47*b* and a width of about 25 μm. Moreover, supply passages S were provided for each of the transfer portions T. In addition, sub-walls 47*c* having a height of about 6 μm and a width of about 10 μm were formed at substantially the central portions of the supply passages S.

As ink for use in a printing operation, dicyanostyryl yellow dye expressed by the following [Chemical Formula 4], tricyanostyryl magenta dye expressed by the following [Chemical Formula 5] and anthraquinone cyan dye expressed by the following [Chemical Formula 6] were dissolved in dibutyl phthalate by about 10 wt % at room temperature. Thus, yellow (Y), magenta (M) and cyan (C) ink solutions were manufactured.

[Chemical Formula 4]

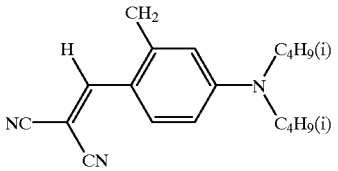

[Chemical Formula 5]

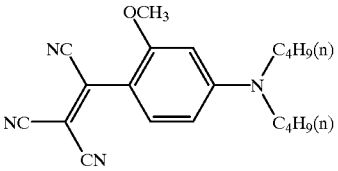

[Chemical Formula 6]

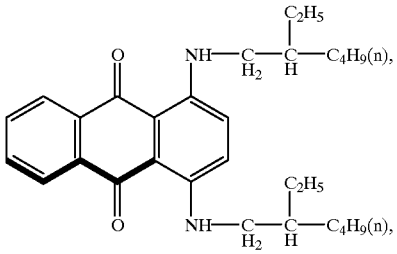

Three printer heads were prepared, and then ink was introduced into each of the heads. Thus, ink was supplied from the ink accumulating portion (given reference numeral 61 shown in FIG. 9), and then passed through each supply passage so as to spontaneously be moved to each transfer portion.

The three printer heads containing ink in the foregoing colors were mounted on a serial printer, and then paper sheets was set. The paper sheets were peach coat paper sheets (manufactured by Nisshinbo). The distance from the paper sheet and the transfer portion of each printer head was about 150 μm. Thus, a printing operation was performed.

Data which must be printed was processed such that time for which a drive pulse which must be supplied to each heater portion was turned on for each dot was changed in 16 steps in a state in which each printer head and the paper sheet were relatively moved. Thus, an image having 16 gradient steps was printed.

The highest sensitivity of yellow (Y), magenta (M) and cyan (C) measured by a Macbeth densitometer were about 1.8, about 1.9 and about 1.8. The maximum density irregularity measured by a microdensitometer (manufactured by Sakatainks) when 256 heater portions of one printer head were operated under the same conditions was about 1.9% or lower. Moreover, density irregularity among adjacent pixels was about 0.9% or lower.

Any excessive density irregularity was not observed among the 256 heater portions at each of 1 to 16 gradient levels. Thus, a uniform transferred image was obtained.

The highest sensitivity levels realized after transference of 100 sheets in A6 size terms were about 2.1, about 2.2 and about 2.0. The maximum density irregularity was about 1.9% or lower, about 2.6% or lower and about 2.0% or lower, respectively. The density irregularity among the adjacent pixels was about 1.2% or lower, about 1.9% or lower and about 1.5% or lower.

Second Embodiment

The structure according to the second embodiment was employed so that a printer head having the transfer portions T formed by the columnar members disposed as shown in FIG. 12 was manufactured. Each of the columnar members 47*b* was formed into a rectangular parallelopiped having a size about 3 μm×about 3 μm and a height of about 6 μm. The columnar members 47*b* were disposed into a 9×9 square matrix in which the intervals of the centers of the columnar members 47*b* were about 6 μm. The adjacent transfer portions T were isolated from one another by partition walls 47*a* having a height of about 6 μm which was substantially the same as that of each of the columnar members 47*b* and a width of about 25 μm. Moreover, supply passages S were provided for each of the transfer portions T. In addition, sub-walls 47*c* having a height of about 6 μm and a width of about 10 μm were formed at substantially the central portions of the supply passages S. The columnar members 47*b* were extended to be in parallel with a portion of the sub-walls 47*c*.

When a printing operation was performed under the same conditions according to Example 2, the highest sensitivity of yellow (Y), magenta (M) and cyan (C) measured by a Macbeth densitometer were about 1.8, about 1.9 and about 1.8. The maximum density irregularity measured after 256 heater portions of one printer head were operated under the same conditions was about 1.9% or lower. Moreover, density irregularity among adjacent pixels was about 0.9% or lower.

Any excessive density irregularity was not observed among the 256 heater portions at each of 1 to 16 gradient levels. Thus, a uniform transferred image was obtained.

Example 3

The structure according to the third embodiment was employed so that a printer head having the transfer portions T formed by the columnar members disposed as shown in FIG. 13 was manufactured. Each of the columnar members 47*b* was formed into a rectangular parallelopiped having a size about 3 μm×about 3 μm and a height of about 6 μm. The columnar members 47*b* were disposed into a 9×9 square matrix in which the intervals of the centers of the columnar members 47*b* were about 6 μm. The adjacent transfer portions T were isolated from one another by partition walls 47*a* having a height of about 6 μm which was substantially the same as that of each of the columnar members 47*b* and a width of about 25 μm. Moreover, supply passages S were provided for each of the transfer portions T. In addition, three lines of columnar members 47*b* were, in place of the sub-walls, extended to substantially the central portion of each of the supply passages S.

When a printing operation was performed under the same conditions according to Example 1, the highest sensitivity of yellow (Y), magenta (M) and cyan (C) measured by a Macbeth densitometer were about 1.8, about 1.9 and about 1.8. The maximum density irregularity measured after 256 heater portions of one printer head were operated under the same conditions was about 1.9% or lower. Moreover, density irregularity among adjacent pixels was about 0.9% or lower.

Any excessive density irregularity was not observed among the 256 heater portions at each of 1 to 16 gradient levels. Thus, a uniform transferred image was obtained.

Example 4

The structure according to the fourth embodiment was employed so that a printer head having the transfer portions T formed by the columnar members disposed as shown in FIG. 14 was manufactured. That is, the columnar members 47*b* similar to those according to Example 1 were disposed on the overall region including the transfer portions T and the supply passages S. The partition walls for isolating the transfer portions T and the supply passages S from one another were omitted from the structure. A partition wall 47*a* having a height of about 6 μm which was the same as that of the columnar members 47*b* and a width of about 15 μm was provided for the leading end portion of the printer head in order to prevent an undesirable flow of ink to the edge of the chip.

When a printing operation was performed under the same conditions according to Example 1, the highest sensitivity of yellow (Y), magenta (M) and cyan (C) measured by a Macbeth densitometer were about 2.1, about 2.2 and about 2.1. The maximum density irregularity measured after 256 heater portions of one printer head were operated under the same conditions was about 1.9% or lower. Moreover, density irregularity among adjacent pixels was about 0.9% or lower.

Any excessive density irregularity was not observed among the 256 heater portions at each of 1 to 16 gradient levels. Thus, a uniform transferred image was obtained.

Comparative Example 1

A printer head having the same structure as that according to Example 1 was manufactured except for the sub-walls omitted from the supply passages S. A printing operation was performed under the same conditions as those according to Example 1.

The highest sensitivity of yellow (Y), magenta (M) and cyan (C) measured by a Macbeth densitometer were about 1.8, about 1.9 and about 1.8.

When a high-density image among 1 to 16 gradient levels which was formed by the heater which was operated for a long time, ink supply was interrupted to a portion of the transfer portions. Thus, several blank portions in the form of lines were formed in the transferred image. As a result, a uniform transferred image was not obtained.

Example 5

The structure according to the ninth embodiment was employed so that a printer head having the transfer portions T having the columnar members disposed as shown in FIG. 20A was manufactured. That is, the printer head having substantially the same structure as that according to Example 1 was manufactured except for the pattern of the columnar members 47*b* disposed such that five central columnar members 47*b* above the heater portions 46*a* were omitted.

A printing operation was performed under the same conditions according to Example 1 to observe movement of ink during the transferring operation. As a result, as shown in FIG. 20C, ink 8 was moved outwards to cover substantially the same areas in all of the transfer portions T.

The highest sensitivity of yellow (Y), magenta (M) and cyan (C) measured by a Macbeth densitometer were about 1.7, about 1.8 and about 1.6. The maximum density irregularity realized when 256 heater portions of one printer head were operated under the same conditions was about 0.6% or lower, about 0.7% or lower and about 0.6% or lower. Moreover, density irregularity among adjacent pixels was about 0.4% or lower, about 0.4% or lower and about 0.3% or lower.

The highest sensitivity levels realized after transference of 100 sheets in A6 size terms were about 1.8, about 2.0 and about 1.7. The maximum density irregularity was about 0.8% or lower, about 0.8% or lower and about 0.7% or lower. The density irregularity among the adjacent pixels was about 0.5% or lower, about 0.6% or lower and about 0.4% or lower.

Example 6

Figure 21A:
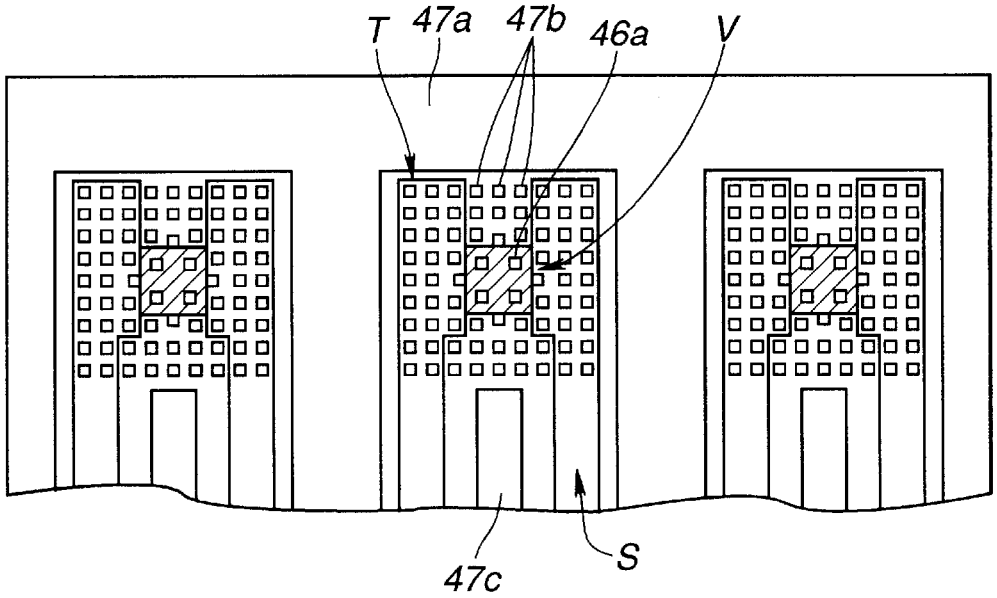
FIG 21A is an enlarged schematic plan view showing a portion including transfer portions of a printer head according to a tenth embodiment of the present invention.
Figure 21B:
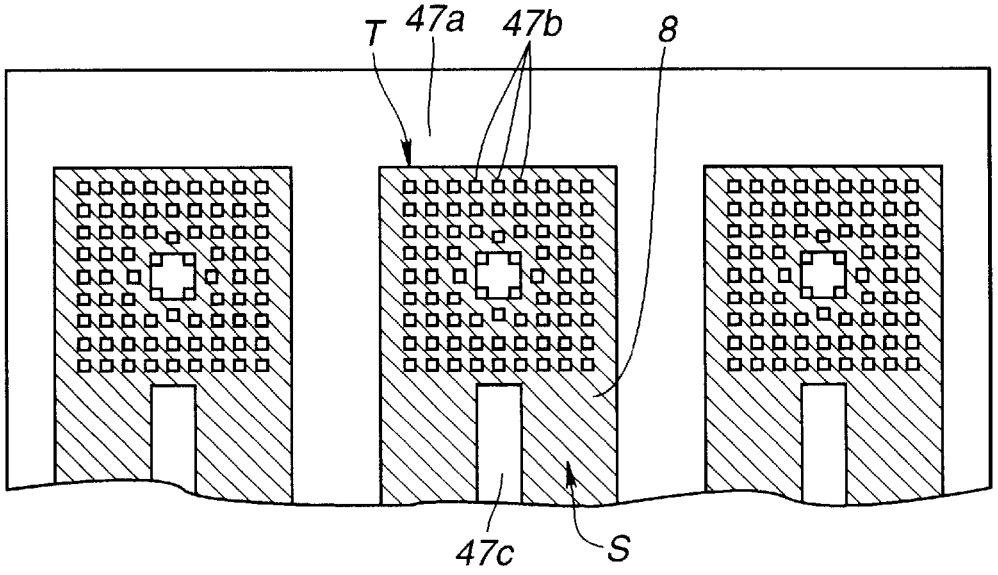
FIG. 21B is an enlarged schematic plan view showing a portion including transfer portions of a printer head according to a tenth embodiment of the present invention.

The structure according to the tenth embodiment was employed so that a printer head having the transfer portions T having the columnar members disposed as shown in FIG. 21A was manufactured. That is, the printer head having substantially the same structure as that according to Example 1 was manufactured except for the pattern of the columnar members 47*b* above the heater portions 46*a* and the other columnar members 47*b* adjacent to the for columnar members 47*b* which were different from those according to Example 1.

A printing operation was performed under the same conditions according to Example 1 to observe movement of ink during the transferring operation. As a result, as shown in FIG. 21B, ink 8 was moved outwards to cover substantially the same areas in all of the transfer portions T.

The highest sensitivity of yellow (Y), magenta (M) and cyan (C) measured by a Macbeth densitometer were about 1.6, about 1.7 and about 1.6. The maximum density irregularity realized when 256 heater portions of one printer head were operated under the same conditions was about 0.7% or lower, about 0.7% or lower and about 0.6% or lower. Moreover, density irregularity among adjacent pixels was about 0.4% or lower, about 0.5% or lower and about 0.3% or lower.

The highest sensitivity levels realized after transference of 100 sheets in A6 size terms were about 1.8, about 1.9 and about 1.6. The maximum density irregularity was about 0.9% or lower, about 0.9% or lower and about 0.7% or lower. The density irregularity among the adjacent pixels was about 0.6% or lower, about 0.7% or lower and about 0.5% or lower.

Example 7

The structure according to the eleventh embodiment was employed so that a printer head having the transfer portions T having the columnar members disposed as shown in FIG. 22A was manufactured. That is, the printer head having substantially the same structure as that according to Example 1 was manufactured except for a rectangular parallelopiped columnar member 47*d* provided for each of the transfer portions T and having a size about 16 $\mu$m×16 $\mu$m and a height of about 6 $\mu$m which was disposed above the heater portions 46*a*.

A printing operation was performed under the same conditions according to Example 1 to observe movement of ink during the transferring operation. As a result, as shown in FIG. 21C, ink 8 was, in all of the transfer portions T, introduced into only the peripheral portion of the heater portions 46*a*.

The highest sensitivity of yellow (Y), magenta (M) and cyan (C) measured by a Macbeth densitometer were about 1.8, about 1.9 and about 1.7. The maximum density irregularity realized when 256 heater portions of one printer head were operated under the same conditions was about 0.5% or lower, about 0.6% or lower and about 0.5% or lower. Moreover, density irregularity among adjacent pixels was about 0.3% or lower, about 0.4% or lower and about 0.3% or lower.

The highest sensitivity levels realized after transference of 100 sheets in A6 size terms were about 2.0, about 2.0 and about 1.8. The maximum density irregularity was about 0.8% or lower, about 0.9% or lower and about 0.7% or lower. The density irregularity among the adjacent pixels was about 0.5% or lower, about 0.5% or lower and about 0.4% or lower.

According to the present invention, there is provided a printer head including: an ink transferring portion for transferring ink to a transfer member disposed opposite to the ink transferring portion and an ink supply passage for supplying ink to the ink transferring portion, wherein the ink transferring portion incorporates a heater for heating ink to discharge ink and an ink holding structure disposed above at least the heater and having a number of small gaps so as to introduce ink into the small gaps by using a capillary phenomenon and hold ink, and the ink supply passage incorporates ink-level holding means for maintaining a predetermined height of the ink level by using surface tension of ink.

Therefore, ink in a sufficiently large quantity can be held also in the ink supply passage. Therefore, only the spontaneous ink flow is sufficient to smoothly and continuously supply ink to the ink transferring portion. As a result, density irregularity of a printed image and formation of a white line can be prevented.

In the present invention, ink cannot easily be introduced or cannot be introduced into a portion above the central portion of the heater of the printer head. The printed head includes the heater for heating ink in order to discharge ink and the ink holding structure formed in a predetermined region including the portion above the heater and having a number of the small gaps to introduce ink into the small gaps by the capillary phenomenon to hold ink.

Therefore, ink is always and substantially heated in only the peripheral portion of the heater. Therefore, the introduction of ink into the portion above the heater and, therefore, rapid change in the quantity of transferred ink can be prevented. That is, considerable change in the quantity of ink which is discharged with heat of the heater can be prevented. As a result, density irregularity of a printed image as time elapses can be prevented and, thus, deterioration in the quality of a printed image can be prevented.

When energy which is supplied to each heater is controlled in accordance with image data which must be printed, the quantity of ink which must be discharged can continuously be controlled. Therefore, a high-quality image can be obtained which has a sufficiently high optical density and which enables a multi-value density gradient to be realized.

Since the printer head and the printer according to the present invention is basically adapted to the thermal transfer method, the size can easily be reduced, maintenance can easily be performed, immediacy can be realized, a high-quality image can be formed and high gradient image can be obtained.

Although other modifications and changes may be suggested by those skilled in the art, it is the intention of the inventors to embody within the patent warranted hereon all changes and modifications as reasonably and properly come within the scope of their contribution to the art.

What is claimed is:

1. A printer head comprising:

a heater for heating and discharging ink, said heater having a peripheral portion and a central portion;

and an ink holding structure disposed above at least said heater and having a plurality of small gaps in which ink is introduced into and held within said plurality of small gaps via a capillary phenomenon wherein, said ink holding structure is present at least a portion above the peripheral portion of said heater, and a portion above the central portion of said heater is formed into a gap having dimensions larger than the corresponding dimensions of each of said small gaps.

2. A printer head according to claim 1, wherein said ink holding structure is formed in a predetermined region of said ink transferring portion, said predetermined region including said heater.

3. A printer head gradient to claim 1, wherein said ink holding structure adjacently disposes a plurality of columnar members, and said plurality of small gaps are continuously formed among said columnar members.

4. A printer head according to claim 3, wherein said plurality of columnar members are substantially disposed in a matrix configuration, and a predetermined region including a portion above the central portion of said heater is formed into said gap in which a predetermined number of said plurality of columnar members are omitted from said matrix configuration.

5. A printer head according to claim 1, wherein the discharging of ink which occurs when ink has been heated by said heater is at least one of a discharge via an ink flow caused from one of a gradient of surface tension and a gradient of interfacial tension generated in ink with heat of said heater, a discharge via vaporization of ink which takes place with heat of said heater and a discharge via ablation of ink which takes place with heat of said heater.

6. A printer head comprising:

a heater for heating and discharging ink; and an ink holding structure disposed in a predetermined region including a portion above said heater and having a plurality of small gaps in which ink is introduced into and held within said plurality of small gaps via a capillary phenomenon, wherein, said portion of said ink holding structure above said heater has a plurality of gaps wider than said plurality of small gaps disposed in the portions except for the portion above said heater.

7. A printer head according to claim 6, wherein said ink holding structure adjacently disposes a plurality of columnar members, and said plurality of small gaps are continuously formed among said plurality of columnar members.

8. A printer head according to claim 7, wherein a first group of said plurality of columnar members are disposed on said heater and a second group of said plurality of columnar members are disposed in the portions and the distances among said plurality of columnar members disposed on said heater are longer than the distances among said plurality of columnar members disposed in the portions except for the portion above said heater.

9. A printer head according to claim 6, wherein the discharging of ink which occurs when ink has been heated by said heater is at least one of a discharge via an ink flow caused from one of a gradient of surface tension and a gradient of interfacial tension generated in ink with heat of said heater, a discharge via vaporization of ink which takes place with heat of said heater and a discharge via ablation of ink which takes place with heat of said heater.

10. A printer head comprising:

a heater for heating and discharging ink, said heater having a periphery and an inside portion of the periphery, and an ink holding structure disposed above at least said heater and having a plurality of small gaps in which ink is introduced into and held within said plurality of small gaps via a capillary phenomenon, wherein, said ink holding structure has an ink-introduction preventive wall formed in a portion above the inside portion of the periphery of said heater to prevent an introduction of ink into a portion above the central portion of said heater.

11. A printer head according to claim 10, wherein said ink holding structure is formed in a predetermined region including said heater.

12. A printer head according to claim 10, wherein said ink holding structure adjacently disposes a plurality of columnar members, and said plurality of small gaps are continuously formed among said columnar members.

13. A printer head according to claim 12, wherein said ink holding structure includes a plurality of first columnar members and a second columnar member disposed in a portion above the central portion of said heater, the second columnar member having a diameter larger than a diameter of each of said first columnar members and an outer wall as an ink-introduction preventive wall.

14. A printer according to claim 10, wherein the discharging of ink which occurs when ink has been heated by said heater is at least one of a discharge via an ink flow caused from one of a gradient of surface tension and a gradient of interfacial tension generated in ink with heat of said heater, a discharge via vaporization of ink which takes place with heat of said heater and a discharge via ablation of ink which takes place with heat of said heater.

15. A printer comprising:

a printer head having a heater for heating and discharging ink and having a peripheral portion and a central portion, and an ink holding structure disposed above at least said heater and having a plurality of small gaps in which ink is introduced into and held within said plurality of small gaps via a capillary phenomenon wherein, said ink holding structure is present in at least a portion above the peripheral portion of said heater, and a portion above the central portion of said heater forms a gap, the gap is larger in dimension than a dimension of each of said plurality of small gaps.

16. A printer according to claim 15, wherein said ink holding structure is formed in a predetermined region including a portion above said heater.

17. A printer according to claim 15, wherein said ink holding structure adjacently disposes a plurality of columnar members, and said plurality of small gaps are continuously formed among said columnar members.

18. A printer according to claim 17, wherein said plurality of columnar members are substantially disposed in a matrix configuration, and a predetermined region including a portion above the central portion of said heater is formed into said gap in which a predetermined number of said columnar members are omitted from said matrix configuration.

19. A printer according to claim 15, wherein the discharging of ink which occurs when ink has been heated by said heater is at least one of a discharge via an ink flow caused from one of a gradient of surface tension and a gradient of interfacial tension generated in ink with heat of said heater, a discharge via vaporization of ink which takes place with heat of said heater and a discharge via ablation of ink which takes place with heat of said heater.

20. A printer comprising:

a printer head having a heater for heating and discharging ink and an ink holding structure disposed in a predetermined region including a portion above said heater and having a plurality of small gaps in which ink is introduced into and held within said plurality of small gaps via a capillary phenomenon, wherein, a portion of said ink holding structure above said heater has a plurality of gaps wider than said plurality of small gaps formed in the portions except for the portion above said heater.

21. A printer according to claim 20, wherein said ink holding structure adjacently disposes a plurality of columnar members, and said plurality of small gaps are continuously formed among said columnar members.

22. A printer according to claim 21, wherein a first group of said plurality of columnar members are disposed on said heater and a second group of said plurality of columnar members are disposed in the portions and the distances among said first group are longer than the distances among said second group except for a portion of the second group above said heater.

23. A printer according to claim 20, wherein the discharging of ink which occurs when ink has been heated by said heater is at least one of a discharge via an ink flow caused from one of a gradient of surface tension and a gradient of interfacial tension generated in ink with heat of said heater, a discharge via vaporization of ink which takes place with heat of said heater and a discharge via ablation of ink which takes place with heat of said heater.

24. A printer comprising:

a printer head having a heater for heating and discharging ink, said heater having a periphery, an inside portion of the periphery and a central portion, and an ink holding structure disposed above at least said heater and having a plurality of small gaps in which ink is introduced into and held within said plurality of small gaps via a capillary phenomenon, wherein, said ink holding structure has an ink-introduction preventive wall formed in a portion above the inside portion of the periphery of said heater to prevent an introduction of ink into a portion above the central portion of said heater.

25. A printer according to claim 24, wherein said ink holding structure is formed in a predetermined region including said heater.

26. A printer according to claim 24, wherein said ink holding structure adjacently disposes a plurality of columnar members, and said plurality of small gaps are continuously formed among said columnar members.

27. A printer according to claim 26, wherein said ink holding structure includes a plurality of first columnar members and a second columnar member disposed in a portion above the central portion of said heater, the second columnar member having a diameter larger than a diameter of each of said first columnar members and an outer wall as an ink-introduction preventive wall.

28. A printer according to claim 24, wherein the discharging of ink which occurs when ink has been heated by said heater is at least one of a discharge via an ink flow caused from one of a gradient of surface tension and a gradient of interfacial tension generated in ink with heat of said heater, a discharge via vaporization of ink which takes place with heat of said heater and a discharge via ablation of ink which takes place with heat of said heater.

* * * * *